US011413883B2

(12) United States Patent
Hirayama

(10) Patent No.: US 11,413,883 B2
(45) Date of Patent: Aug. 16, 2022

(54) LIQUID APPLYING APPARATUS

(71) Applicant: Yuushi Hirayama, Shizuoka (JP)

(72) Inventor: Yuushi Hirayama, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/218,162

(22) Filed: Mar. 31, 2021

(65) Prior Publication Data

US 2021/0316558 A1 Oct. 14, 2021

(30) Foreign Application Priority Data

Apr. 14, 2020 (JP) ..... JP2020-072157

(51) Int. Cl.

| | |
|---|---|
| ***B41J 13/00*** | (2006.01) |
| ***B41J 11/00*** | (2006.01) |
| ***B41M 7/00*** | (2006.01) |
| ***B41J 13/10*** | (2006.01) |

(52) U.S. Cl.

CPC ..... *B41J 11/0015* (2013.01); *B41J 13/0036* (2013.01); *B41J 13/106* (2013.01); *B41M 7/0018* (2013.01); *B41M 7/0027* (2013.01)

(58) Field of Classification Search

CPC ..... B41J 29/38; B41J 11/0015; B41J 11/002; B41J 11/0021; B41J 11/0095; B41J 11/66; B41J 13/0009; B41J 13/0036

See application file for complete search history.

(56) References Cited

U.S. PATENT DOCUMENTS

| | | | | |
|---|---|---|---|---|
| 2013/0101330 | A1* | 4/2013 | Yoshida | B26D 7/1863 400/621 |
| 2020/0024092 | A1* | 1/2020 | Taniguchi | B65H 85/00 |
| 2020/0317460 | A1* | 10/2020 | Kakuta | B65H 29/60 |

FOREIGN PATENT DOCUMENTS

| | | |
|---|---|---|
| JP | 2019-509195 | 4/2019 |
| WO | WO2017/123258 A1 | 7/2017 |

* cited by examiner

*Primary Examiner* — Scott A Richmond

(74) *Attorney, Agent, or Firm* — Xsensus LLP

(57) ABSTRACT

A liquid applying apparatus includes a liquid applier, a heating device, and a post-processing apparatus. The liquid applier is configured to discharge liquid to a sheet. The heating device is configured to heat the sheet on which the liquid is applied, by the liquid applier. The post-processing apparatus is configured to perform a post-processing operation to the sheet that has passed the heating device. An upstream sheet that is conveyed after the sheet and located upstream from the post-processing apparatus in a sheet conveyance direction stops in an area other than a heat area of the heating device when the post-processing apparatus performs the post-processing operation on the sheet.

9 Claims, 27 Drawing Sheets

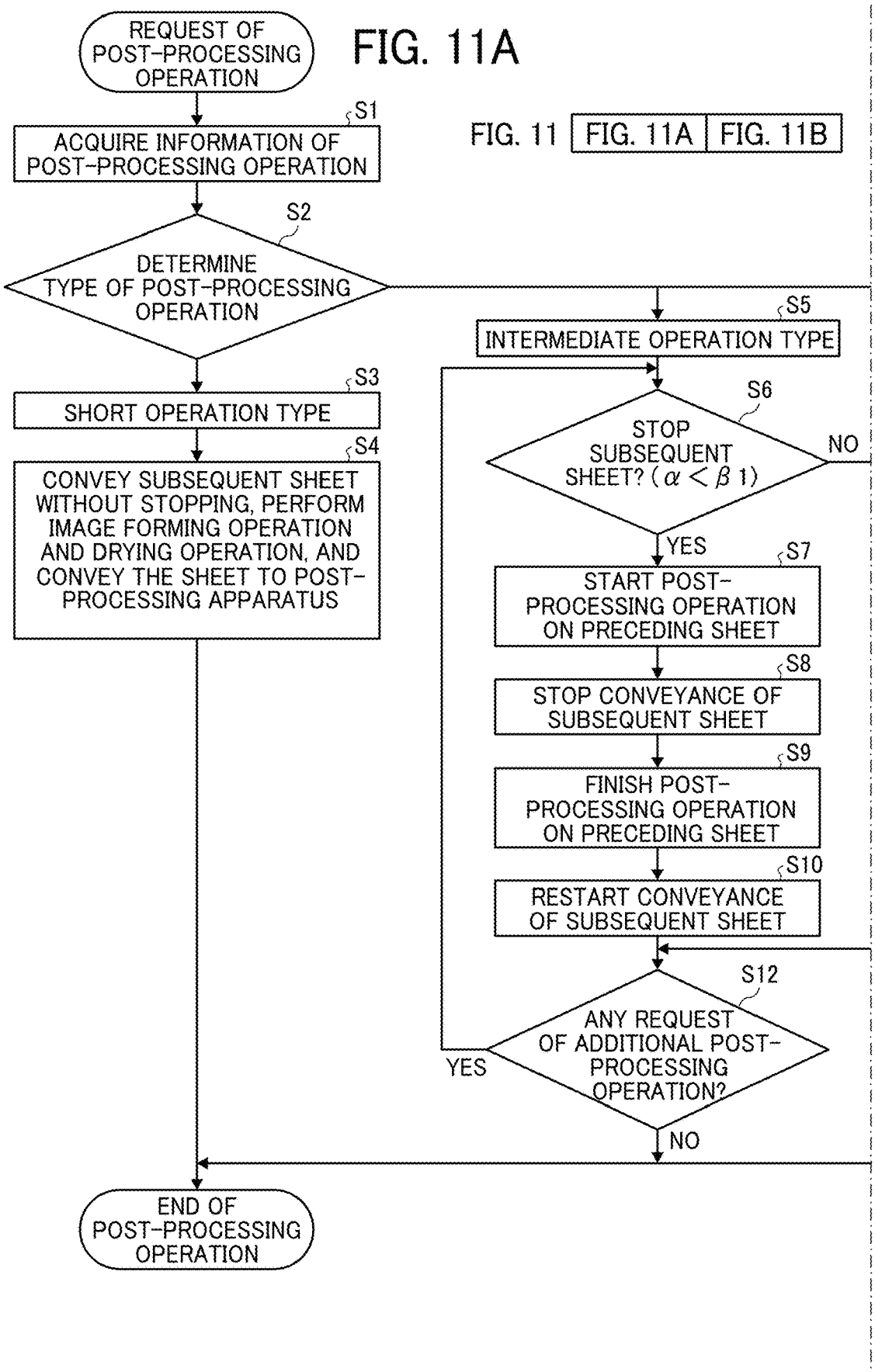
FIG. 11A
FIG. 11
FIG. 11A
FIG. 11B
REQUEST OF POST-PROCESSING OPERATION
S1
ACQUIRE INFORMATION OF POST-PROCESSING OPERATION
S2
DETERMINE TYPE OF POST-PROCESSING OPERATION
S3
SHORT OPERATION TYPE
S4
CONVEY SUBSEQUENT SHEET WITHOUT STOPPING, PERFORM IMAGE FORMING OPERATION AND DRYING OPERATION, AND CONVEY THE SHEET TO POST-PROCESSING APPARATUS
S5
INTERMEDIATE OPERATION TYPE
S6
STOP SUBSEQUENT SHEET? (α < β 1)
NO
YES
S7
START POST-PROCESSING OPERATION ON PRECEDING SHEET
S8
STOP CONVEYANCE OF SUBSEQUENT SHEET
S9
FINISH POST-PROCESSING OPERATION ON PRECEDING SHEET
S10
RESTART CONVEYANCE OF SUBSEQUENT SHEET
S12
ANY REQUEST OF ADDITIONAL POST-PROCESSING OPERATION?
YES
NO
END OF POST-PROCESSING OPERATION

LIQUID APPLYING APPARATUS

CROSS-REFERENCE TO RELATED APPLICATION

This patent application is based on and claims priority pursuant to 35 U.S.C. § 119(a) to Japanese Patent Application No. 2020-072157, filed on Apr. 14, 2020, in the Japan Patent Office, the entire disclosure of which is hereby incorporated by reference herein.

BACKGROUND

Technical Field

Embodiments of the present disclosure relate to a liquid applying apparatus.

Background Art

Various types of liquid applying apparatuses such as inkjet image forming apparatuses that applies ink to a sheet to form an image on the sheet are known to include a post-processing device that performs a post-processing operation, e.g., a stapling operation and a punching operation, to the sheet on which liquid such as ink is applied.

For example, a known liquid applying apparatus includes a heating device (fixing device) to heat and dry a sheet on which liquid is applied, before conveying the sheet to a post-processing apparatus (finisher).

SUMMARY

At least one aspect of this disclosure, a novel liquid applying apparatus includes a liquid applier, a heating device, and a post-processing apparatus. The liquid applier is configured to discharge liquid to a sheet. The heating device is configured to heat the sheet on which the liquid is applied, by the liquid applier. The post-processing apparatus is configured to perform a post-processing operation to the sheet that has passed the heating device. An upstream sheet that is conveyed after the sheet and located upstream from the post-processing apparatus in a sheet conveyance direction stops in an area other than a heat area of the heating device when the post-processing apparatus performs the post-processing operation on the sheet.

BRIEF DESCRIPTION OF THE SEVERAL VIEWS OF THE DRAWINGS

Exemplary embodiments of this disclosure will be described in detail based on the following figures, wherein:

FIG. 11 including FIGS. 11A and 11B is a flowchart illustrating a control flow of the sheet conveying operation;

Figure 1:
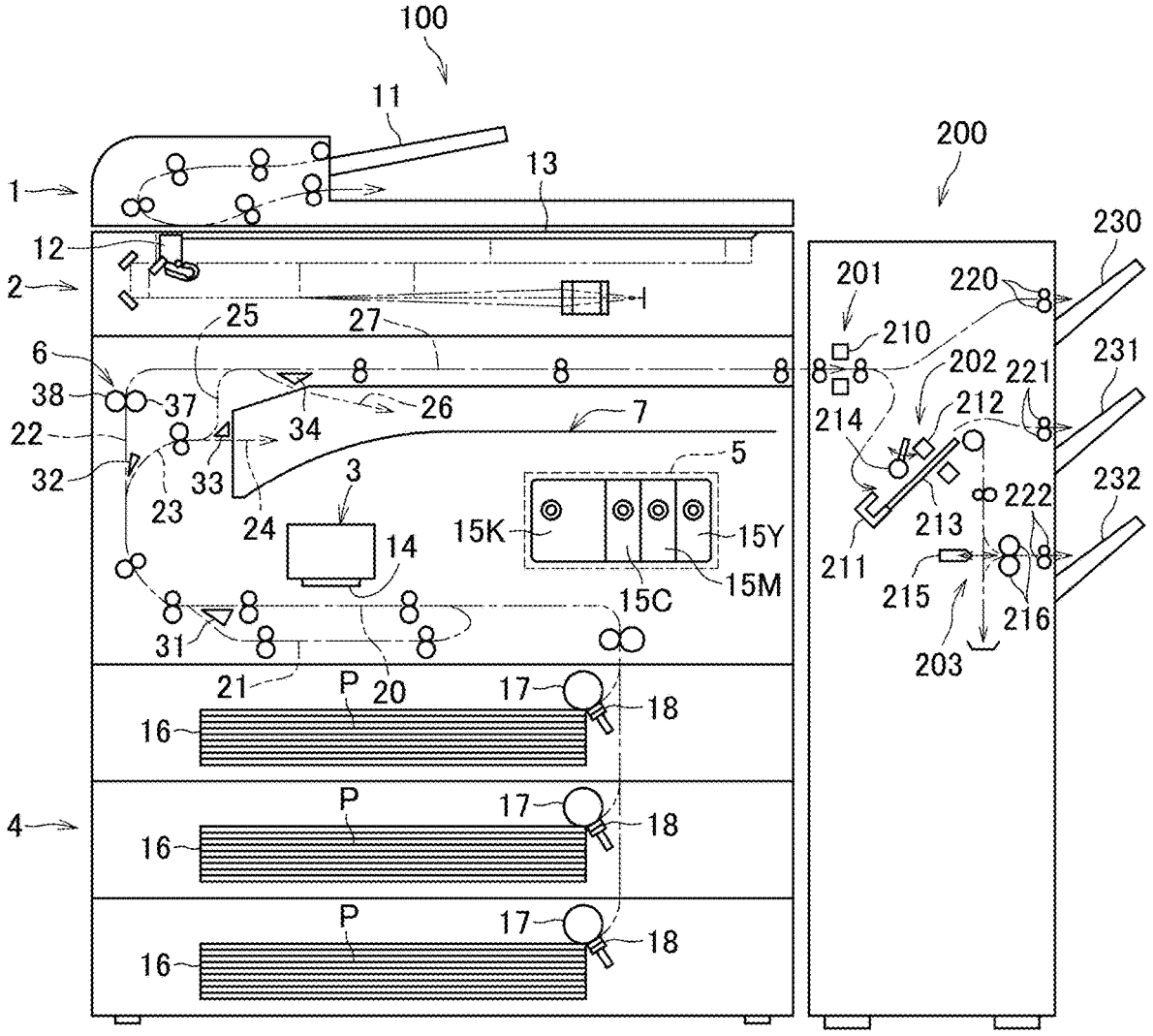
FIG. 1 is a diagram illustrating a schematic configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a liquid applying apparatus. It is to be noted that elements (for example, mechanical parts and components) having the same functions and shapes are denoted by the same reference numerals throughout the specification and redundant descriptions are omitted.

FIG. 1 is a diagram illustrating a schematic configuration of an image forming apparatus according to an embodiment of the present disclosure.

As illustrated in FIG. 1, an image forming apparatus 100 according to the present embodiment includes an original document conveying device 1, an image reading device 2, an image forming device 3, a sheet feeding device 4, a cartridge container 5, a drying device 6, and a sheet ejection portion 7. Further, a post-processing apparatus 200 is disposed adjacent to the image forming apparatus 100. The post-processing apparatus 200 may be included in the image forming apparatus 100.

The original document conveying device 1 separates an original document from the other original documents one by one from a set of original documents on an original document tray 11 and conveys the separated original document toward an exposure glass 13 of the image reading device 2. The original document conveying device 1 includes a plurality of conveyance rollers each functioning as an original document conveyor to convey the original document.

The image reading device 2 is an image scanner, that is, a device to scan the image on an original document placed on the exposure glass 13 or the image on an original document as the original document passes over the exposure glass 13. The image reading device 2 includes an optical scanning unit 12 as an image reading unit. The optical scanning unit 12 includes a light source that irradiates an original document placed on the exposure glass 13 with light, and a charge-coupled device (CCD) as an image reader that reads an image from the reflected light of the original document. Further, a close contact-type image sensor (CIS) may be employed as an image reader.

The image forming device 3 includes a liquid discharge head 14 that functions as a liquid applier to apply liquid to a sheet. The liquid discharge head 14 discharges ink that is liquid used for image formation and applies the ink to the sheet. The liquid discharge head 14 may be a serial-type liquid discharge head that discharges ink while moving in the main scanning direction of a sheet (i.e., the sheet width direction) or a line-type liquid discharge head that discharges ink without moving a plurality of liquid discharge heads aligned in the main scanning direction. Note that the detailed configuration and operations of each of the serial-type liquid discharge head 14 and the line-type liquid discharge head 14 will be described below.

Ink cartridges 15Y, 15M, 15C, and 15K are detachably attached to the cartridge container 5. The ink cartridges 15Y, 15M, 15C, and 15K are filled with inks of different colors such as yellow, magenta, cyan, and black, respectively. The ink in each ink cartridge (i.e., the ink cartridges 15Y, 15M, 15C, 15K) is supplied to the liquid discharge head 14 by an ink supply pump.

The drying device 6 is a heating device that heats a sheet to dry ink on the sheet. The drying device 6 according to the present embodiment heats the sheet while holding the sheet by a pair of rollers including a heat roller 37 and a pressure roller 38. The detailed description of the configuration and operations of the drying device 6 is deferred. Alternatively, the drying device 6 may be a hot air generator that blows hot air onto the sheet to heat the sheet.

The sheet feeding device 4 includes a plurality of sheet feed trays 16 each functioning as a sheet container. Each sheet feed tray 16 loads a bundle of sheets including a sheet P. Each sheet P on which an image is formed is a cut sheet cut in a predetermined size, e.g., A4 size and B4 size, and is previously contained in the sheet feed tray 16 in a corresponding sheet conveyance direction. Further, each sheet feed tray 16 includes a sheet feed roller 17 that functions as a sheet feeder and a sheet separation pad 18 that functions as a sheet separator.

The post-processing apparatus 200 performs a post-processing operation on the sheets P conveyed from the image forming apparatus 100. The post-processing apparatus 200 according to the present embodiment includes a hole puncher 201, a sheet binder 202, and a sheet folder 203, each functioning as a post-processing device that performs the post-processing operation on the sheets P. The post-processing apparatus 200 may further include another post-processing device such as a sheet cutter that cuts the sheets P in addition to the hole puncher 201, the sheet binder 202, and the sheet folder 203.

The hole puncher 201 includes a punching unit 210 to make holes in a sheet. Further, the sheet binder 202 includes a side stapling unit 211, a saddle stitching unit 212, a stacking tray 213, and a sheet alignment roller 214. The side stapling unit 211 binds the end of the sheets P in the sheet conveyance direction. The saddle stitching unit 212 binds the center in the sheet conveyance direction. The stacking tray 213 stacks the sheets P for the binding operation. The sheet alignment roller 214 aligns the sheets P. The sheet folder 203 includes a pushing member 215 and a pair of sheet folding rollers 216. The pushing member 215 pushes the center of the bundle of sheets P in the sheet conveyance direction. The pair of sheet folding rollers 216 grips the bundle of sheets P pushed by the pushing member 215 and folds the bundle of sheets P in half. Note that the sheet folder 203 in the present embodiment makes a two-fold by folding a sheet in two at one folding position but may make a three-fold by folding a sheet with a valley fold in three at two folding positions with the outer panels facing in or a Z-fold by folding a sheet with a valley fold and a mountain fold in three at two folding positions with the outer panels facing in and out. The post-processing apparatus 200 further includes a plurality of pairs of sheet ejection rollers 220, 221, and 222 and a plurality of sheet ejection trays 230, 231, and 232. The bundle of sheets P after the post-processing operation is conveyed to the sheet ejection tray 230 via the pair of sheet ejection roller 220, to the sheet ejection tray 231 via the pair of sheet ejection roller 221, or to the sheet ejection tray 232 via the pair of sheet ejection rollers 222.

To provide a fuller understanding of the embodiments of the present disclosure, a description is now given of the basic image forming operation of the image forming apparatus 100 according to the present embodiment, with continued reference to FIG. 1.

As an instruction is given to start the printing operation, the sheet P is fed from one sheet feed tray 16 of the plurality of sheet feed trays 16. To be more specific, as the sheet feed roller 17 rotates, the uppermost sheet P placed on top of the bundle of sheets P contained in the sheet feed tray 16 is fed by the sheet feed roller 17 and the sheet separation pad 18 while the uppermost sheet P is separated from the other sheets of the bundle of sheets.

When the sheet P is conveyed to a sheet conveyance passage 20 that extends in the horizontal direction and faces the image forming device 3, the image forming device 3 forms an image on the sheet P. To be more specific, the liquid discharge head 14 is controlled to discharge liquid (ink) according to image data of the original document read by the image reading device 2 or print data instructed to print by an external device, so that ink is discharged on the image forming surface (upper face) of the sheet P to form an image. Note that the image to be formed on the sheet P may be a meaningful image such as text or a figure, or a pattern having no meaning per se.

When duplex printing is performed, the sheet P is conveyed in the opposite direction opposite the sheet conveyance direction at a position downstream from the image forming device 3 in the sheet conveyance direction, so that the sheet P is guided to a sheet reverse passage 21. To be more specific, after the trailing end of the sheet P has passed a first passage changer 31 that is disposed downstream from the image forming device 3 in the sheet conveyance direction, the first passage changer 31 changes the sheet conveyance passage to the sheet reverse passage 21, and therefore the sheet P is conveyed in the opposite direction. Accordingly, the sheet P is guided to the sheet reverse passage 21. Then, as the sheet P passes through the sheet reverse passage 21, the sheet P is reversed upside down and conveyed to the image forming device 3 again. Then, the image forming device 3 repeats the same operation performed to the front face of the sheet P, so as to form an image on the back face of the sheet P.

A second passage changer 32 is disposed downstream from the first passage changer 31 in the sheet conveyance direction. The second passage changer 32 guides the sheet P with the image selectively to a sheet conveyance passage 22 that runs through the drying device 6 or to a sheet conveyance passage 23 that does not run through the drying device 6. When the sheet P is guided to the sheet conveyance passage 22 through which the sheet P passes the drying device 6, the drying device 6 dries the ink on the sheet P. On the other hand, when the sheet P is guided to the sheet conveyance passage 23 through which the sheet P does not pass the drying device 6, a third passage changer 33 guides the sheet P selectively to a sheet conveyance passage 24 toward the sheet ejection portion 7 or to a sheet conveyance passage 25 toward the post-processing apparatus 200. Further, after the sheet P has passed the drying device 6, a fourth passage changer 34 guides the sheet P selectively to a sheet conveyance passage 26 toward the sheet ejection portion 7 or to a sheet conveyance passage 27 toward the post-processing apparatus 200.

In a case in which the sheet P is guided to the sheet conveyance passage 24 or the sheet conveyance passage 26 toward the sheet ejection portion 7, the sheet P is ejected to the sheet ejection portion 7 with an image forming surface down. Here, the image forming surface indicates a liquid applied face of the sheet P on which ink is applied. On the other hand, in a case in which the sheet P is guided to the sheet conveyance passage 25 or the sheet conveyance passage 27 toward the post-processing apparatus 200, the sheet P is conveyed to the post-processing apparatus 200, so that the specified post-processing operation is performed. Note that, in a case in which an image is formed on only one face (e.g., the image forming surface) of the sheet P, the sheet P is conveyed to the post-processing apparatus 200 with the image forming surface of the sheet P facing down.

In a case in which the designated post-processing operation is the punching operation, when the sheet P is conveyed to the hole puncher 201, the punching unit 210 operates to make a hole of holes at the predetermined position(s) in the sheet P while the sheet P is being conveyed. The sheet P with the hole(s) is ejected to the sheet ejection tray 230 by the pair of sheet ejection rollers 220.

In a case in which the designated post-processing operation is the binding operation for the end of the bundle of sheets, the sheets P skip the punching operation and are conveyed to the sheet binder 202 and stacked on the stacking tray 213. At this time, in the present embodiment, the sheet P is placed on the stacking tray 213 with the image forming surface facing down. When the sheet P is stacked on the stacking tray 213, the sheet alignment roller 214 contacts the upper face of the sheet P and rotates in the clockwise direction in FIG. 1. Along with the rotation of the sheet alignment roller 214, as the sheet P is moved toward the lower left side of FIG. 1, the leading end of the sheet P in the sheet conveyance direction contacts a contact portion of the stacking tray 213, so that the sheet P is positioned at the predetermined position. Similarly, a predetermined number of sheets P are sequentially conveyed to the stacking tray 213 and contact the contact portion by the sheet alignment roller 214, so that the leading end of each sheet P is aligned. In this state, the side stapling unit 211 performs the binding operation to bind the end of the bundle of sheets P. Thereafter, as the sheet alignment roller 214 rotates in the counterclockwise direction in FIG. 1, the bundle of sheets P is conveyed from the stacking tray 213 and ejected to the sheet ejection tray 231 by the pair of sheet ejection rollers 221.

Further, in a case in which the designated post-processing operation is the binding operation for the center of the bundle of sheets, the sheets P skip the punching operation and are conveyed to the sheet binder 202 and stacked on the stacking tray 213, as in the binding operation for the end of the bundle of sheets. In this case, the sheet P is also placed on the stacking tray 213 with the image forming surface facing down. Then, after the predetermined number of sheets P are sequentially conveyed to the stacking tray 213, the sheets P are aligned by the sheet alignment roller 214 and the saddle stitching unit 212 binds the center of the bundle of sheets P. Thereafter, the sheet alignment roller 214 conveys the bundle of sheets P downward in FIG. 1, from the stacking tray 213. Then, the center of the bundle of sheets is pushed by the pushing member 215 toward the pair of sheet folding rollers 216 to be gripped by the pair of sheet folding rollers 216. As a result of this action, a fold is created at the center of the bundle of sheets, so that the bundle of sheets is folded in two. Thereafter, the bundle of sheets is conveyed by the pair of sheet folding rollers 216 while the pair of sheet folding rollers 216 is rotating and is ejected to the sheet ejection tray 232 by the pair of sheet ejection rollers 222.

As described above, a series of printing operations and post-processing operations are completed.

Next, a description is given of the configuration of the serial-type liquid discharge head 14 as an example of the image forming device 3.

Figure 2:
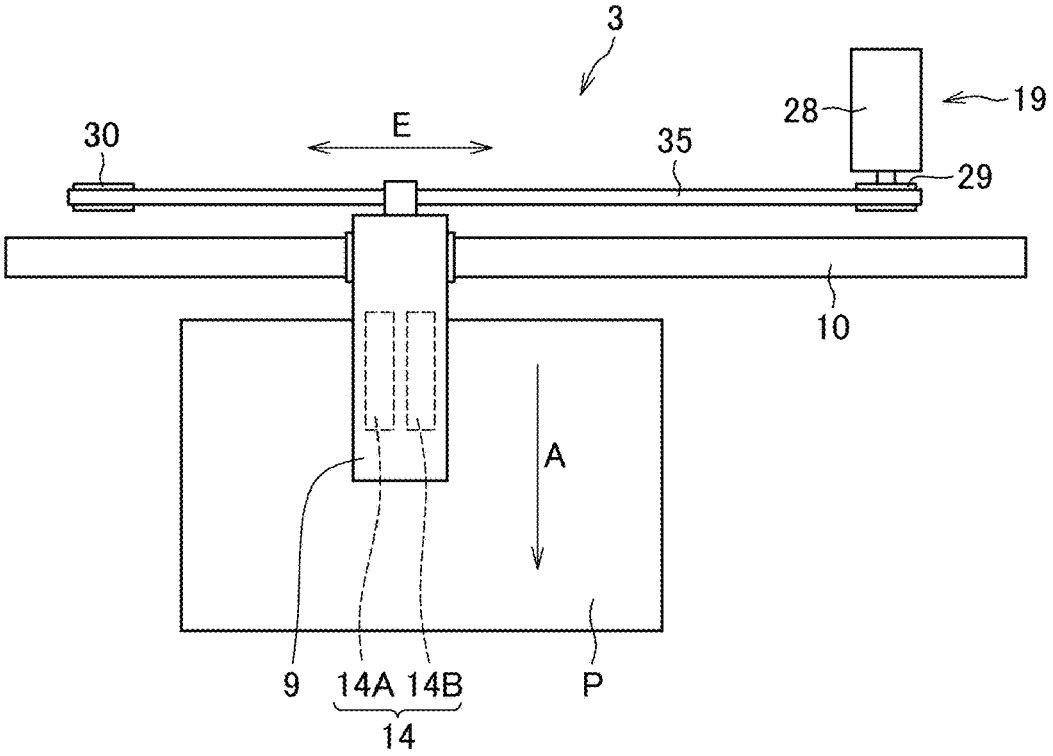
FIG. 2 is a plan view illustrating an image forming device including a serial-type liquid discharge head.

FIG. 2 is a plan view illustrating the image forming device 3 including the serial-type liquid discharge head 14.

As illustrated in FIG. 2, the image forming device 3 includes a carriage 9, a guide (guide rod) 10, and a drive device 19. The carriage 9 is provided with the liquid discharge head 14. The guide 10 guides the carriage 9 in the main scanning direction E that is a sheet width direction of the sheet P.

The liquid discharge head 14 in the present embodiment includes a monochrome liquid discharge head 14A and a color liquid discharge head 14B. The monochrome liquid discharge head 14A includes discharge port rows, from each of which black ink liquid is discharged. The color liquid discharge head 14B includes discharge port rows, from each of which cyan, magenta, and yellow ink liquids are discharged. The monochrome liquid discharge head 14A and the color liquid discharge head 14B are provided on the carriage 9. Each of the monochrome liquid discharge head 14A and the color liquid discharge head 14B has a face on which the discharge port rows are formed, and the face is disposed facing down. In other words, the ink discharge direction of ink from the discharge port rows is downward, so that each of the monochrome liquid discharge head 14A and the color liquid discharge head 14B is disposed in a direction in which each discharge port row intersects with the main scanning direction E. This direction is hereinafter referred to as a sheet conveyance direction A. Note that a liquid discharge head may be provided for each of the different colors. Alternatively, the liquid discharge head may include a head that discharges each of black ink and cyan ink and a head that discharges each of magenta ink and yellow ink. Further, the color of ink to be used in the image forming apparatus 100 is not limited to the above-described colors.

As an energy generator to discharge ink from each of the monochrome liquid discharge head 14A and the color liquid discharge head 14B, a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Further, a plurality of sub tanks to supply and refill ink to the monochrome liquid discharge head 14A and the color liquid discharge head 14B is provided on the carriage 9. Respective color inks are supplied from the ink cartridges 15Y, 15M, 15C, and 15K (see FIG. 1) provided in the housing of the image forming apparatus 100, to each of the plurality of sub tanks, via respective ink supply tubes.

The drive device 19 includes a motor 28 that is a drive source, a drive pulley 29, a driven pulley 30, and a timing belt 35 that is wound around the drive pulley 29 and the driven pulley 30. As the motor 28 is driven to rotate the drive pulley 29, the timing belt 35 is moved endlessly, so that the carriage 9 coupled with the timing belt 35 moves in the main scanning direction E along the guide 10. By changing the rotational direction of the motor 28 between one direction and the opposite direction, the carriage 9 moves reciprocally in the main scanning direction E.

In the image forming device 3 provided with the serial-type liquid discharge head 14, as the monochrome liquid discharge head 14A and the color liquid discharge head 14B discharge ink according to the image signal while the carriage 9 is moving in the main scanning direction E, an image for one line is formed on the sheet P that remains stationary. Then, after the sheet P has been conveyed by the predetermined distance in a direction indicated by arrow A illustrated in FIG. 2, the subsequent line of the image is formed on the sheet P. Thereafter, as in the above-described operation, conveyance and stop of the sheet P and the reciprocating motion of the carriage 9 are repeated, so that ink is discharged onto the sheet P to form the full image.

Next, a description is given of the configuration of the line-type liquid discharge head 14 as another example of the image forming device 3.

Figure 3:
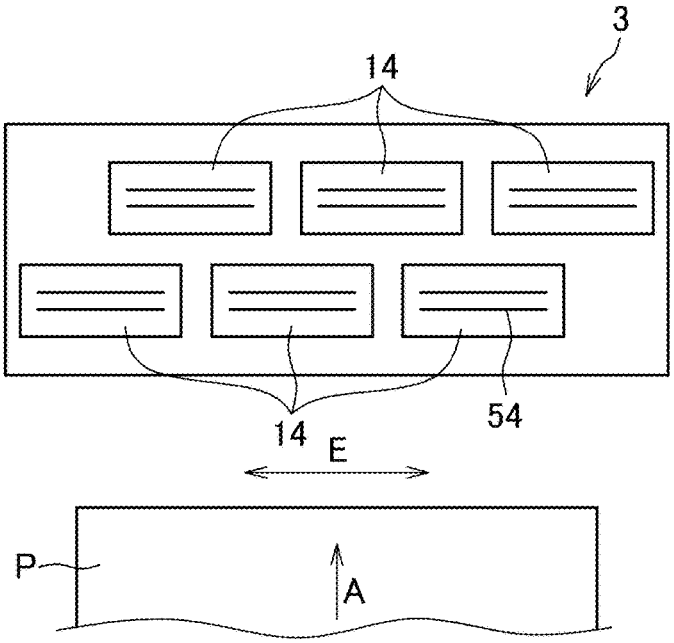
FIG. 3 is a plan view illustrating an image forming device including a line-type liquid discharge head.

FIG. 3 is a plan view illustrating the image forming device 3 including the line-type liquid discharge head 14.

As illustrated in FIG. 3, the image forming device 3 includes a plurality of liquid discharge heads 14 aligned in the sheet conveyance direction A and th sheet width direction (main scanning direction E) of a base 36. Each of the monochrome liquid discharge head 14A and the color liquid discharge head 14B is provided with a nozzle row 54 with the arrangement of a plurality of nozzles.

In this case, as the sheet P is conveyed to the image forming device 3, when the sheet P passes through the opposing region facing the image forming device 3, the driving of ink discharge from each of the monochrome liquid discharge head 14A and the color liquid discharge head 14B is controlled by the drive signal based on the image information. Therefore, ink of each color is discharged from each of the monochrome liquid discharge head 14A and the color liquid discharge head 14B onto the sheet P. Accordingly, an image according to the image information is formed on the sheet P.

Figure 4:
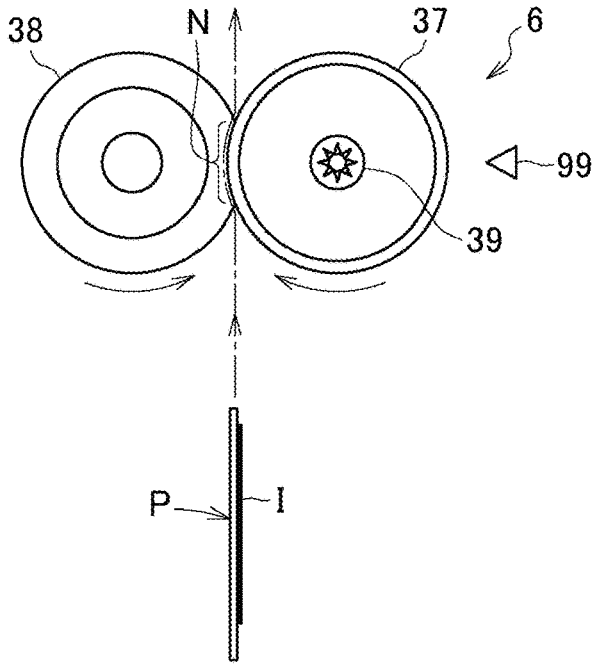
FIG. 4 is a diagram illustrating a schematic configuration of a drying device provided in the image forming apparatus of FIG. 1.

FIG. 4 is a diagram illustrating a schematic configuration of the drying device 6 provided in the image forming apparatus 100 of FIG. 1, according to the present embodiment.

As illustrated in FIG. 4, the drying device 6 includes the heat roller 37, the pressure roller 38, a heater 39, and a temperature sensor 99.

The heat roller 37 is a heating member that heats the sheet P and is a heat rotator that rotates. In the present embodiment, the heat roller 37 is a hollow roller having the outer diameter of, e.g., 30 mm and has a cylindrical iron core metal and a release layer formed on the outer circumferential surface of the iron core metal. The iron core metal has a thickness of, e.g., 0.5 mm to 2 mm and is made of iron alloy or aluminum alloy. Further, the release layer is made of a fluororesin.

The pressure roller 38 is a pressing member that is pressed by the heat roller 37 and is a pressure rotator that is a pressure body that rotates. In the present embodiment, the pressure roller 38 is a hollow roller having the outer diameter of, e.g., 30 mm and has a cylindrical iron core metal, an elastic layer formed on the outer circumferential surface of the cylindrical iron core metal, and a release layer formed on the outside of the elastic layer. The iron core metal is made of iron alloy, for example. The elastic layer is made of silicone rubber and has a thickness of, e.g., 5 mm. Further, the release layer is made of a fluororesin. In the drying device 6 according to the present embodiment, since the pressure roller 38 is biased toward the heat roller 37 by a pressing member such as a spring and a cam, the pressure roller 38 is pressed in contact with the outer circumferential surface of the heat roller 37. Thus, a nip region N is formed between the heat roller 37 and the pressure roller 38.

The heater 39 is a heat source to heat the heat roller 37. In the present embodiment, the heater 39 is disposed inside the heat roller 37, so that the heat roller 37 is heated from inside by the heater 39. Further, the heater 39 may be disposed outside the heat roller 37. As a heat source, a radiation-type heater, e.g., a halogen heater and a carbon heater, to emit infrared ray, and an electromagnetic induction-type heat source may be employed. Further, the heater may be a contact-type heater or a non-contact type heater. In the present embodiment, a halogen heater is used as a heater 39.

Further, the temperature sensor 99 functions as a temperature detector to detect the surface temperature of the heat roller 37, in other words, the temperature of the outer circumferential surface of the heat roller 37. By controlling the output of the heater 39 based on the surface temperature of the heat roller 37 detected by the temperature sensor 99, the surface temperature of the heat roller 37 is controlled to be a desired temperature (fixing temperature). To be more specific, the heater 39 is controlled to maintain the surface temperature of the heat roller 37 within the range of, e.g., from 100° C. to 180° C. The temperature sensor 99 may be any of a contact-type sensor and a non-contact sensor. As the temperature sensor 99, a known temperature sensor such as a thermopile, a thermostat, a thermistor, or an NC (normally closed) sensor may be applied.

Next, a description is given of the operation and functions of the drying device 6.

As the instruction for image formation is issued to the image forming apparatus 100, as illustrated in FIG. 4, the pressure roller 38 rotated in a direction indicated by arrow in FIG. 4 (that is, a counterclockwise direction). By so doing, the heat roller 37 is rotated together with the rotation of the pressure roller 38. On the other hand, the heat roller 37 may rotate and the pressure roller 38 may be rotated together with the rotation of the heat roller 37. Further, the heater 39 starts to generate heat, so that the heat roller 37 is heated by the heater 39. Further, the pressure roller 38 in contact with the heat roller 37 is also indirectly heated.

In a case in which the surface temperature of the heat roller 37 has reached the target temperature (for example, 100° C. to 180° C.) and the sheet P on which liquid ink I is applied is conveyed to the drying device 6, as illustrated in FIG. 4, as the sheet P enters (the nip region N) between the heat roller 37 and the pressure roller 38, the sheet P is conveyed by a pair of rotating rollers, which are the heat roller 37 and the pressure roller 38, while being held by the pair of rollers. At this time, the sheet P is continuously heated by the heat roller 37, which further accelerates the drying of the ink I on the sheet P. Note that the pressure roller 38 is also heated for some extent, the sheet P is also heated by the pressure roller 38. Then, the sheet P is ejected from (the nip region N) between the heat roller 37 and the pressure roller 38 and is conveyed to the sheet ejection portion 7 or the post-processing apparatus 200 as described above.

Alternatively, when performing duplex printing, after images have been formed on both the front and back faces of the sheet P, the sheet P may be conveyed to the drying device 6 to dry the ink on the front and back faces of the sheet P simultaneously or the image on the front face of the sheet P and the image on the back face of the sheet P may be dried separately. In particular, in a case in which the image on the front face of the sheet P and the image on the back face of the sheet P are dried separately, it is preferable that, after the image on the front face of the sheet P has been dried, the sheet P is conveyed to the image forming device 3 again without passing through the drying device 6. For example, after the sheet P has passed through the drying device 6 to dry the image on the front face of the sheet P, the sheet P is switched back and conveyed in the sheet conveyance passage 25 and the sheet conveyance passage 23 illustrated in FIG. 1. Then, the sheet P is guided to the image forming device 3 via the sheet reverse passage 21 illustrated in FIG. 1. Further, the sheet P may not be conveyed in the sheet conveyance passage 25 and the sheet conveyance passage 23, but may be conveyed toward upstream from the sheet conveyance passage 22 (upstream from the drying device 6) in the sheet conveyance direction via a different sheet conveyance passage that detours the drying device 6 and may be guided to the image forming device 3 via the sheet reverse passage 21. Then, after the image forming device 3 has formed an image on the back face of the sheet P, the sheet P is conveyed to the drying device 6 again to cause the drying device 6 to perform the drying process on the image on the back face of the sheet P.

In the image forming apparatus 100 according to the present embodiment, when a plurality of sheets are sequentially conveyed to the post-processing apparatus 200, the subsequent sheet cannot enter the post-processing apparatus 200 until the post-processing operation to the preceding sheet completes. Therefore, the subsequent sheet may need to stand by at a position before the post-processing apparatus 200 (in other words, a position upstream from the post-processing apparatus 200 in the sheet conveyance direction). At that time, if the subsequent sheet stops while the subsequent sheet enters the drying device 6, the sheet P is heated and the portion contacting the heat roller 37 in particular is strongly heated, and therefore ununiform heating occurs to the sheet. As a result, the amount of water evaporated from the sheet varies, and the sheet is likely to wrinkle. Further, since the sheet is excessively heated while the sheet is stopped, it is also likely to degrade the printing quality such as discoloration caused by the excessive heat. Further, there is a problem of energy consumption due to wasteful consumption of heat of the drying device and a problem of shortening the life of the heater.

Therefore, in the present embodiment, in order to address these problems, when the post-processing apparatus 200 performs the post-processing operation on the preceding sheet, the subsequent sheet is stopped at a position that is not easily affected by head from the drying device 6. The subsequent sheet is stopped at the position even if the sheet is not affected by heat. To be more specific, the subsequent sheet is stopped at any of a first stop position, a second stop position, and a third stop position.

Figure 5:
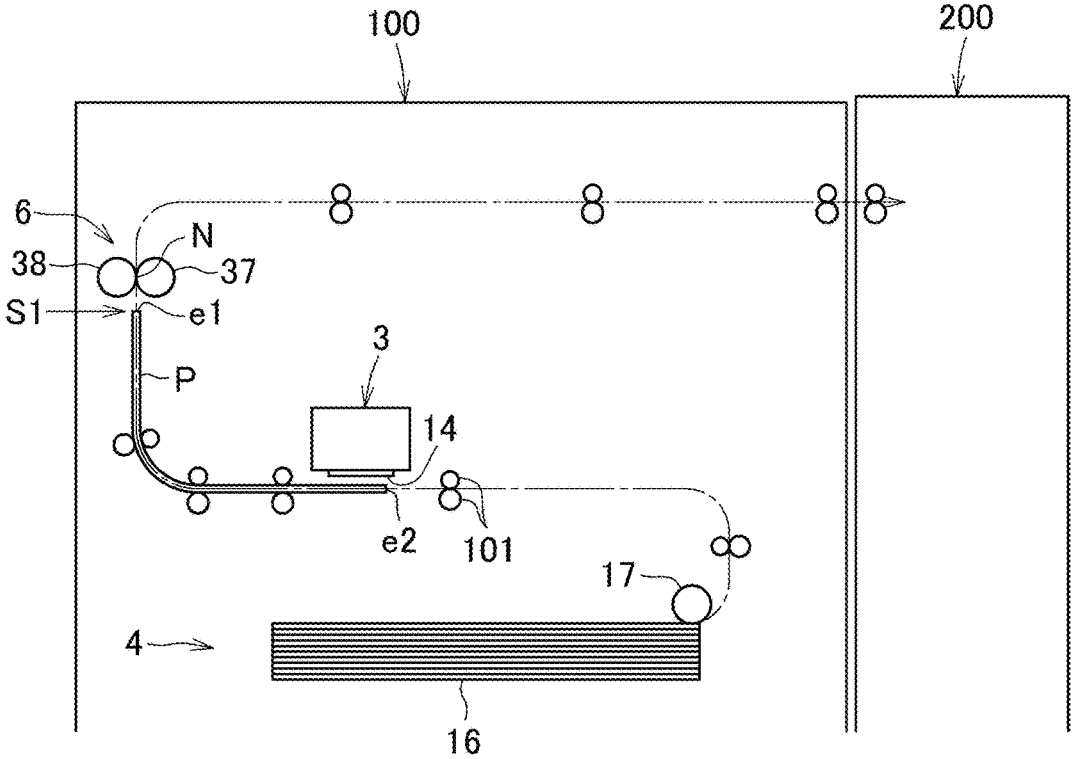
FIG. 5 is a diagram illustrating a state in which a subsequent sheet is stopped at a first stop position.

FIG. 5 is a diagram illustrating a state in which the subsequent sheet P is stopped at a first stop position SP1.

In this case, as illustrated in FIG. 5, as the subsequent sheet P (upstream sheet) is conveyed upstream from the post-processing apparatus 200 in the sheet conveyance direction, the subsequent sheet P is stopped at a timing after the leading end e1 of the subsequent sheet P has passed the liquid application position that is an opposing position of the liquid discharge head 14 and before the subsequent sheet P enters (the nip region N) between the heat roller 37 and the pressure roller 38 of the drying device 6. As a result, the entire subsequent sheet P from the leading end e1 to the trailing end e2 in the sheet conveyance direction is disposed upstream form the nip region N in the sheet conveyance direction without entering the nip region N.

Here, the nip region N of the drying device 6 is a heat area in which the sheet in particular is positively heated (significantly affected by application of heat) due to contact of the heat roller 37 to the sheet. Therefore, if the subsequent sheet P is stopped while entering the nip region N, which is the heat area, it is likely that the subsequent sheet P is partly strongly heated. Therefore, when stopping the subsequent sheet P at the position upstream from the post-processing apparatus 200 in the sheet conveyance direction, the subsequent sheet P is stopped at the first stop position SP1 as illustrated in FIG. 5 so that the entire part of the subsequent sheet P stands by in the area other than the heat area (nip region N). In other words, the subsequent sheet P stops in an area in which the subsequent sheet P does not contact the heat roller 37 of the drying device 6 while the post-processing apparatus 200 performs the post-processing operation on the preceding sheet P. Accordingly, the effect of heat from the drying device 6 to the subsequent sheet P while the subsequent sheet P stands by is reduced, in other words, the subsequent sheet P is less affected by heat from the drying device 6 while the sheet stands by.

However, as illustrated in FIG. 5, in a case in which the subsequent sheet P is stopped before the trailing end e2 of the subsequent sheet P passes the liquid application position (opposing position) of the liquid discharge head 14, the subsequent sheet P is stopped when an image is not completely formed on the subsequent sheet P. Therefore, when the subsequent sheet P is stopped at the liquid application position (opposing position) of the liquid discharge head 14, it is preferable that the liquid discharge head 14 temporarily stops the ink discharging operation (liquid applying operation) along with the stop timing of the subsequent sheet P.

As described above, in a case in which the subsequent sheet P is stopped at the liquid application position of the liquid discharge head 14, it is preferable that the ink discharging operation of the liquid discharge head 14 is also stopped. However, if the ink discharging operation is temporarily stopped, the positional deviation and unevenness of an image may occur when the image forming operation is restarted along with the restart of conveyance of the subsequent sheet P. In particular, when the liquid discharge head 14 is a line-type liquid discharge head, ink is discharged while the sheets are continuously conveyed. Therefore, if the ink discharging operation is temporarily stopped, the positional deviation and unevenness of an image tends to occur easily when the image forming operation is restarted. Therefore, in a case in which the liquid discharge head 14 is a line-type liquid discharge head, the subsequent sheet P is preferably stopped in an area other than the liquid application position of the liquid discharge head 14, for example, at a second stop position SP2 or a third stop position SP3, which are described below. On the other hand, when the liquid discharge head 14 is a serial-type liquid discharge head, ink is discharged line by line while the sheets are intermittently conveyed. Therefore, even if the ink discharging operation is temporarily stopped, the positional deviation and unevenness of an image do not occur easily. Therefore, in a case in which the liquid discharge head 14 is a serial-type liquid discharge head, when the subsequent sheet P is stopped in an area other than the heat area, the ink discharging operation may be stopped temporarily at the timing that the ink discharging operation for one line or multiple lines to the subsequent sheet P is finished (in the middle of the image forming operation).

Figure 6:
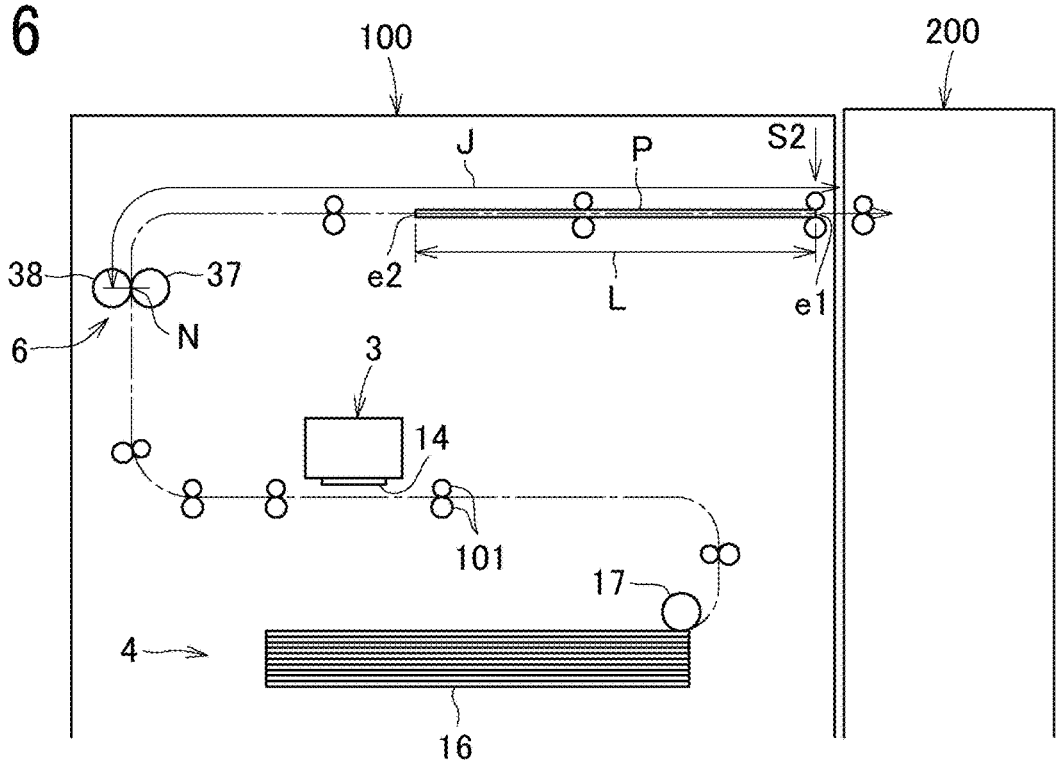
FIG. 6 is a diagram illustrating a state in which the subsequent sheet is stopped at a second stop position.

FIG. 6 is a diagram illustrating a state in which the subsequent sheet P is stopped at a second stop position SP2.

In FIG. 6, the subsequent sheet P is stopped in the area between the nip region N of the drying device 6 and the post-processing apparatus 200 (post-processing device). That is, in this case, the subsequent sheet P is stopped so that the trailing end e2 of the subsequent sheet P is located downstream from the nip region N of the drying device 6 in the sheet conveyance direction and the leading end e1 of the subsequent sheet P is located upstream from the post-processing apparatus 200 in the sheet conveyance direction. This configuration and operation of the image forming apparatus 100 is applied when the length L of the subsequent sheet P in the sheet conveyance direction is shorter than a distance J from the nip region N of the drying device 6 to the post-processing apparatus 200 (post-processing device) in the sheet conveyance direction. Note that, as the post-processing apparatus 200 according to the present embodiment, in a case in which the liquid applying apparatus (e.g., the image forming apparatus 100) includes a post-processing apparatus including a plurality of post-processing devices, e.g., the hole puncher 201, the sheet binder 202, and the sheet folder 203 and the distances J from the nip region N of the drying device 6 to respective post-processing devices, it may be determined whether the subsequent sheet P is stopped between the nip region N of the drying device 6 and each of the post-processing devices based on the distance between the nip region N of the drying device 6 and the post-processing device that is performing the post-processing operation.

As described above, in the example of the image forming apparatus 100 illustrated in FIG. 6, the subsequent sheet P is stopped at a position between the nip region N of the drying device 6 and the post-processing apparatus 200 (post-processing device), so that the entire part of the subsequent sheet P stands by in an area other than the heat area (nip region N). Accordingly, the effect of heat from the drying device 6 to the subsequent sheet P while the subsequent sheet P stands by is reduced, in other words, the subsequent sheet P is less affected by heat from the drying device 6 while the sheet stands by. Further, in this case, since the subsequent sheet P is not located at the liquid application position of the liquid discharge head 14, in other words, the subsequent sheet P is stopped at the area other than the liquid application position, the positional deviation and unevenness of an image that may occur when the image forming operation is temporarily stopped is prevented.

Figure 7:
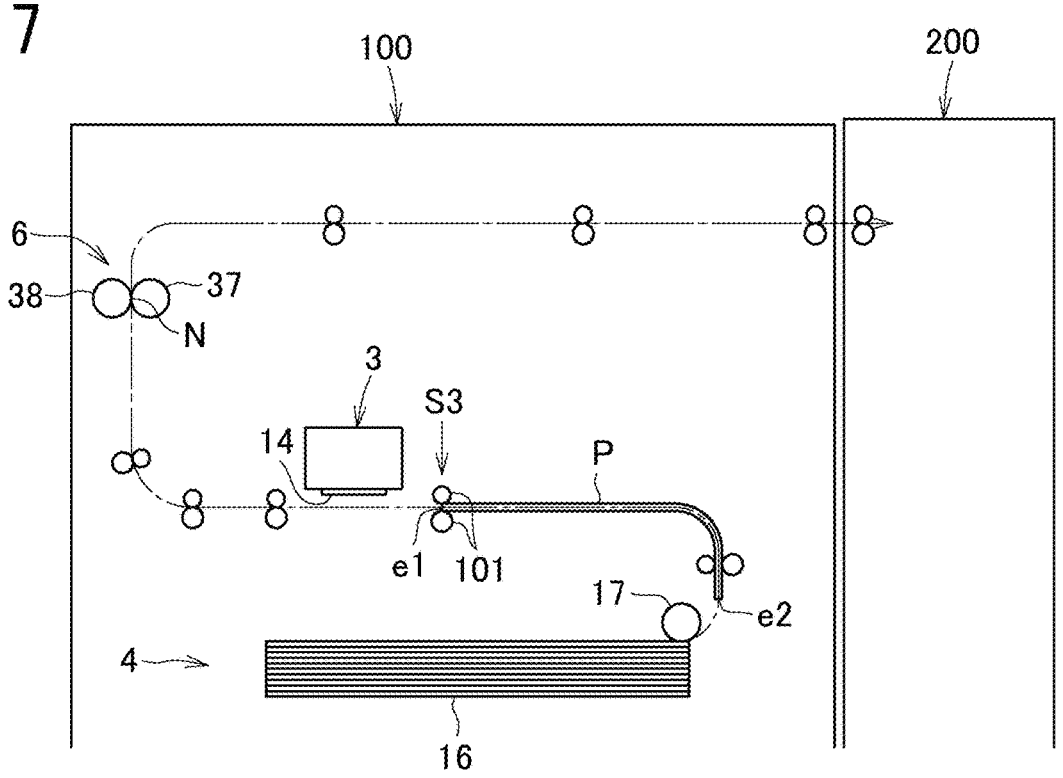
FIG. 7 is a diagram illustrating a state in which the subsequent sheet is stopped at a third stop position.

Subsequently, FIG. 7 is a diagram illustrating a state in which the subsequent sheet P is stopped at a third stop position SP3.

As illustrated in FIG. 7, in this case, the subsequent sheet P is stopped at a timing before the leading end e1 of the subsequent sheet P reaches the liquid application position (opposing position) of the liquid discharge head 14 (e.g., at the position of the pair of timing rollers 101 that conveys the sheet P to the image forming device 3). Also in this case, since the entire part of the subsequent sheet P (from the leading end e1 to the trailing end e2 of the subsequent sheet P in the sheet conveyance direction) is located in an area other than the heat area (nip region N), the effect of heat from the drying device 6 to the subsequent sheet P while the subsequent sheet P stands by is reduced, in other words, the subsequent sheet P is less affected by heat from the drying device 6 while the sheet stands by. Further, in this case, since the subsequent sheet P is not located at the liquid application position of the liquid discharge head 14, in other words, the subsequent sheet P is stopped at the area other than the liquid application position, the positional deviation and unevenness of an image that may occur when the image forming operation is temporarily stopped is prevented. Further, the above-described configuration and operation of the image forming apparatus 100 in which the subsequent sheet P is stopped at the third stop position SP3 is preferably applied when the length L of the subsequent sheet P in the sheet conveyance direction is equal to or greater than the distance J from the nip region N of the drying device 6 to the post-processing apparatus 200 (post-processing device) in the sheet conveyance direction and when the subsequent sheet P cannot be stopped at the second stop position SP2 illustrated in FIG. 6.

Figure 8:
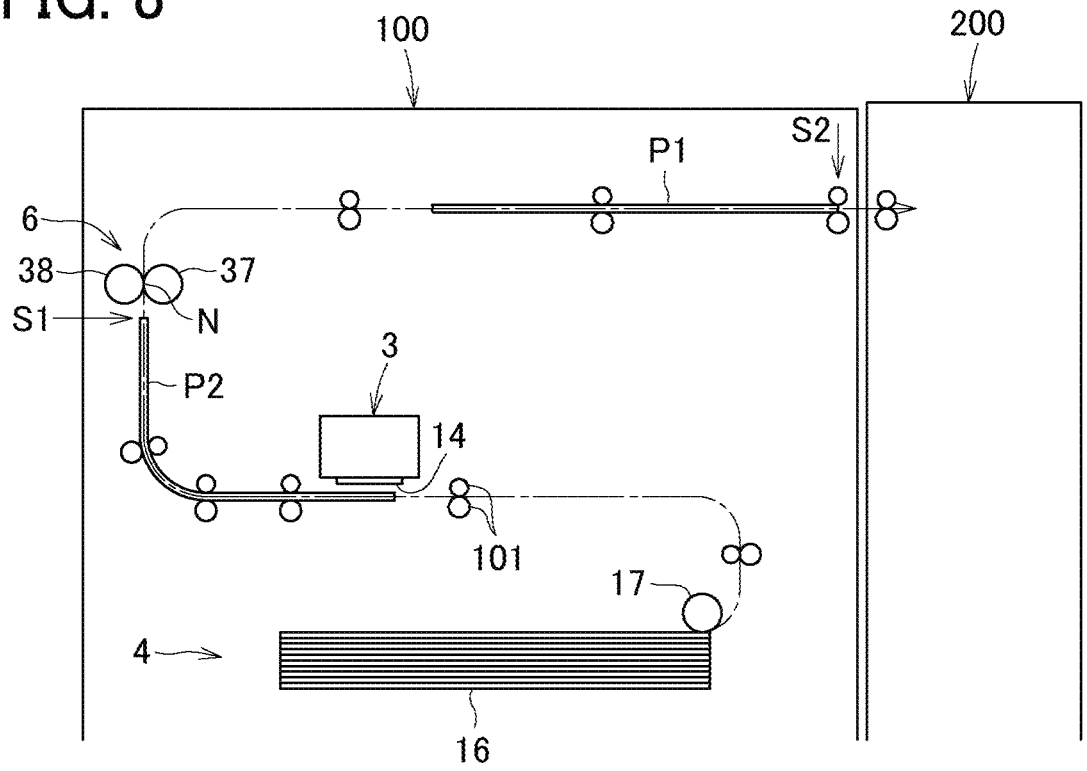
FIG. 8 is a diagram illustrating an example of stopping two subsequent sheets.

FIG. 8 is a diagram illustrating an example of stopping two subsequent sheets.

In the example of the image forming apparatus 100 illustrated in FIG. 8, a subsequent sheet P1 of two subsequent sheets is stopped at the second stop position SP2 and a subsequent sheet P2 of the two subsequent sheets is stopped at the first stop position SP1. By stopping two subsequent sheets, that is, the subsequent sheets P1 and P2 at separate stop positions at which the two subsequent sheets interfere with each other, each of the subsequent sheets P1 and P2 stands by in an area other than the heat area (nip region N) of the drying device 6.

Figure 9:
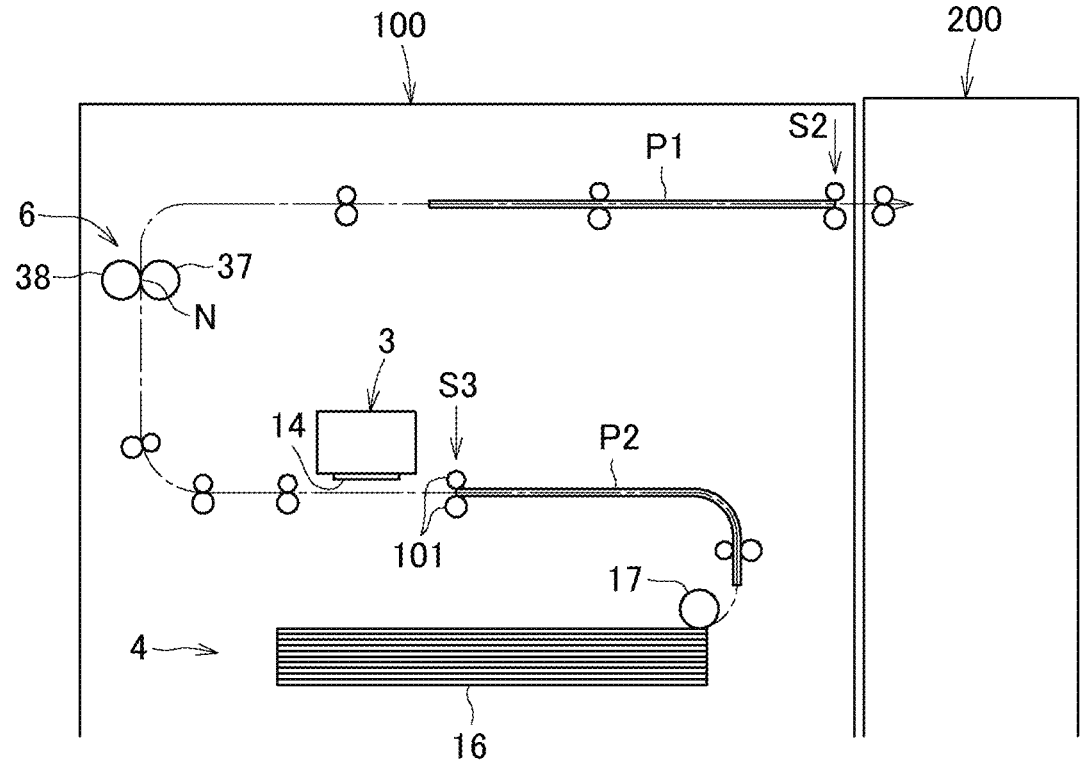
FIG. 9 is a diagram illustrating another example of stopping two subsequent sheets.

Further, FIG. 9 is a diagram illustrating another example of stopping two subsequent sheets.

As in the example illustrated in FIG. 9, the subsequent sheet P1 of two subsequent sheets may be stopped at the second stop position SP2 and the subsequent sheet P2 of the two subsequent sheets may be stopped at the third stop position SP3. In particular, in this case, since both of the subsequent sheets P1 and P2 are stopped at respective areas other than the liquid application position of the liquid discharge head 14, the positional deviation and unevenness of an image that may occur when the image forming operation is temporarily stopped is prevented.

As described above, in the present embodiment, when the post-processing operation is performed on the preceding sheet including one sheet or bundle of sheets), the subsequent sheet is stopped at any of the above-described stop position, so that the subsequent sheet stands by in an area other than the heat area of the drying device. Accordingly, the effect of heat from the drying device to the subsequent sheet while the subsequent sheet stands by is reduced, in other words, the subsequent sheet is less affected by heat from the drying device while the sheet stands by. Therefore, occurrence of wrinkle in a sheet due to uneven heating to the sheet and degradation of the printing quality such as discoloration caused by the excessive heating to a sheet are restrained.

Further, when causing the subsequent sheet to stand by, the power of the heater 39 of the drying device 6 may be turned off. Accordingly, wasteful heat generation of the heater 39 while the subsequent sheet stands by is reduced, thereby enhancing the energy saving performance and extending the service life of the heater 39. On the other hand, if the power of the heater 39 is turned off, it takes a certain period of time to reheat the heater 39 to the predetermined temperature when the heater 39 is turned on again. In order to address this inconvenience, when the subsequent sheet is stopped before the drying operation in particular (e.g., the example of FIG. 5 or the example of FIG. 7), a quick drying operation is not performed after the restart of conveyance of the sheet. Therefore, in a case in which the subsequent sheet is stopped in an area upstream from the nip region N of the drying device 6 in the sheet conveyance direction, in order to perform the drying operation quickly after the restart of conveyance of the sheet, the heater 39 may keep heating without turning off the power of the heater 39.

As described above, in the present embodiment, while the post-processing operation is performed on preceding sheet, the subsequent sheet stands by before the post-processing apparatus without entering the post-processing apparatus. However, the time required to perform the post-processing operation depends on the type of the post-processing operation. Therefore, if the time required to perform the post-processing operation is relatively short and the post-processing operation on the preceding sheet finishes before the subsequent sheet reaches the predetermined stop position, the subsequent sheet is conveyed to the post-processing apparatus without stopping.

Therefore, as in the example described below, whether or not to temporarily stop conveyance of the subsequent sheet may be determined according to the time required to perform the post-processing operation on the preceding sheet. Hereinafter, a description is given of an example of controlling stop and conveyance of a subsequent sheet according to the operation type of the post-processing operation.

Figure 10:
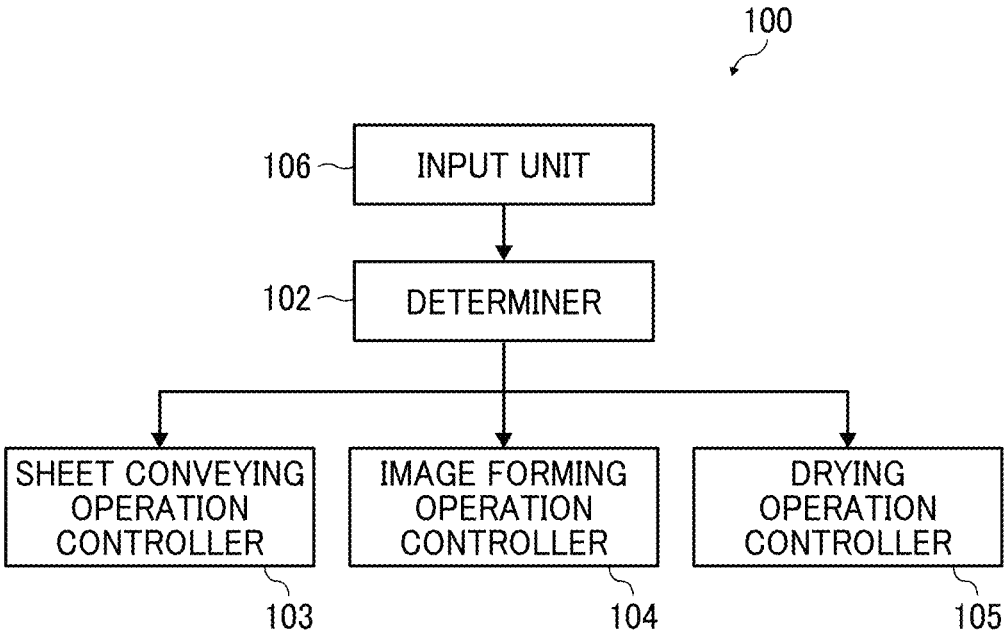
FIG. 10 is a block diagram illustrating a control system to control stopping and conveying of the subsequent sheet.

FIG. 10 is a block diagram illustrating a control system to control stopping and conveying of the subsequent sheet.

As illustrated in FIG. 10, the image forming apparatus 100 includes a sheet conveying operation controller 103, an image forming operation controller 104, and a drying operation controller 105, each functioning as a controller. The sheet conveying operation controller 103 controls driving of a pair of sheet conveying rollers that conveys a sheet. The image forming operation controller 104 controls image formation to the sheet. The drying operation controller 105 controls driving of the drying device including the power on of the heater. The image forming apparatus 100 illustrated in FIG. 10 further includes a determiner 102 that functions as a controller to determine whether or not to convey the subsequent sheet, drive the drying device, or stop the image forming operation, in other words, to control the sheet conveying operation, the drying operation, and the image forming operation. The sheet conveying operation controller 103, the drying operation controller 105, and the image forming operation controller 104 control the driving of the pair of sheet conveying rollers, the driving of the drying device, and the image forming operation, respectively, based on the determination result of the determiner 102.

The determiner 102 determines whether or not to stop the driving of the drying device or the image forming operation as well as whether or not to stop the subsequent sheet at the predetermined stop position, based on the post-processing information input via a control panel mounted on the image forming apparatus 100 or via an input unit 106 of another terminal device different from the image forming apparatus 100. Note that the predetermined stop position is a stop position other than the heat area of the drying device including any one of the first stop position SP1, the second stop position SP2, and the third stop position SP3.

Next, a description is given of the control flow of the sheet conveying operation, with reference to FIG. 11.

Figure 11B:
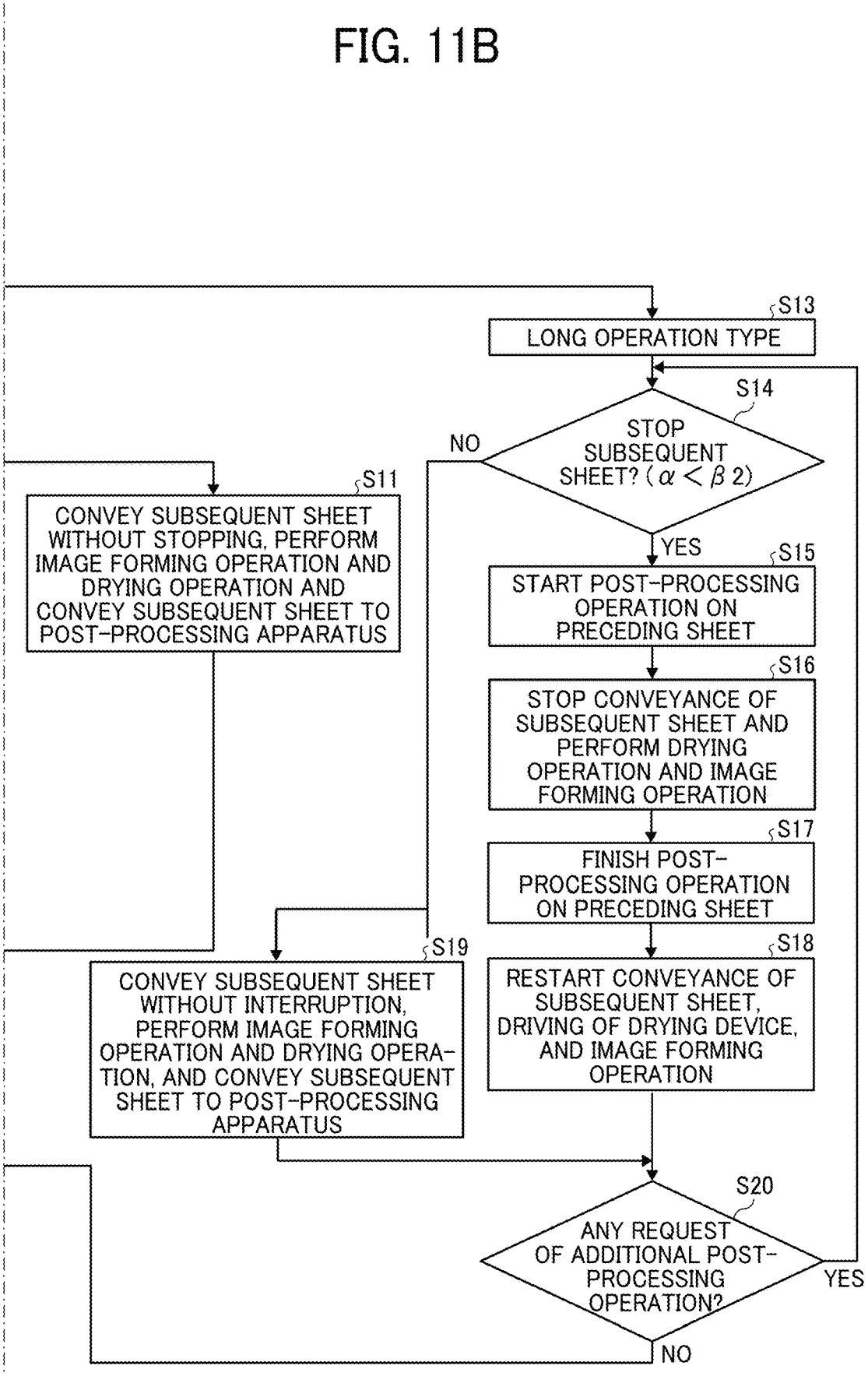

FIG. 11 (including FIGS. 11A and 11B) is a flowchart illustrating the control flow of the sheet conveying operation.

As illustrated in FIG. 11 (including FIGS. 11A and 11B), as the post-processing operation is requested, the determiner 102 acquires information of the post-processing operation input via the input unit 106 (step S1 in the flowchart of FIG. 11). Then, the determiner 102 determines the type of the post-processing operation based on the information acquired from the input unit 106 (step S2 in the flowchart of FIG. 11). In the control flow illustrated in FIG. 11, the post-processing operation is divided into three operation types having different times required to perform the post-processing operation, which are a short operation type, an intermediate operation type, and a long operation type. To be more specific, the short operation type is the post-processing operation that takes a relatively short time, for example, the operation to punch holes in each sheet and eject the sheet and the hole punching operation and the sheet binding operation on a relatively thin booklet. The intermediate operation type is the post-processing operation that takes a time longer than the short operation type, for example, the hole punching operation and the sheet binding operation on a bundle of sheets. The long operation type is the post-processing operation that takes a time longer than the intermediate operation type, for example, the Z-fold binding or the saddle stitching operation.

As a result, when it is determined that the post-processing operation is the short operation type (step S3 in the flowchart of FIG. 11), the subsequent sheet is conveyed without stopping so that the image forming operation and the drying operation are performed on the subsequent sheet and the subsequent sheet is conveyed to the post-processing apparatus (step S4 in the flowchart of FIG. 11). That is, in this case, since the time required to perform the post-processing operation is relatively short, even if conveyance of the subsequent sheet is not temporarily stopped, the post-processing operation on the preceding sheet finishes before the subsequent sheet enters the post-processing apparatus.

On the other hand, when it is determined that the type of the post-processing operation is the intermediate operation type (step S5 in the flowchart of FIG. 11) or the long operation type (step S13 in the flowchart of FIG. 11), the subsequent sheet is likely to enter the post-processing apparatus before the post-processing operation on the preceding sheet finishes. Therefore, it is determined whether or not the subsequent sheet is stopped at the predetermined stop position (step S6 for the intermediate operation type or step S14 for the long operation type in the flowchart of FIG. 11).

To be more specific, based on the information of the post-processing operation acquired from the input unit 106, the determiner 102 first calculates a post-processing time $\beta 1$ or a post-processing time $\beta 2$ for the post-processing operation. At this time, in a case in which the post-processing time differs depending on the sheet size if the common post-processing operation is performed, the post-processing time $\beta 1$ or the post-processing time $\beta 2$ is calculated according to the sheet size. Further, the determiner 102 calculates an arrival time $\alpha$ of the sheet at the stop position from when the preceding sheet is conveyed to the post-processing apparatus 200 (post-processing device) to when the leading end of the subsequent sheet reaches the predetermined stop position, based on information from, for example, a detection sensor that detects the sheet. Note that, in a case in which the post-processing operation is performed on a bundle of sheets, the arrival time $\alpha$ of the sheet at the stop position represents the time from when the last preceding sheet is conveyed to the post-processing apparatus 200 (post-processing device) to when the leading end of the subsequent sheet in the sheet conveyance direction reaches the predetermined stop position. Further, when the intervals (of sheets) between the preceding sheet and the subsequent sheet are different, the arrival time $\alpha$ of the sheet at the stop position may be determined according to the interval. Further, the post-processing time $\beta 1$ or the post-processing time $\beta 2$ and the arrival time $\alpha$ of the sheet at the stop position are not limited to the case of calculation based on the information of the post-processing operation input from the input unit 106 but may be extracted from a data table that is previously created.

Then, the determiner 102 compares the obtained post-processing time $\beta 1$ or the obtained post-processing time $\beta 2$ with the arrival time $\alpha$ of the sheet at the stop position, and then determines whether or not the arrival time $\alpha$ of the sheet at the stop position is shorter than the post-processing time $\beta 1$ ($\alpha<\beta 1$) (step S6 in the flowchart of FIG. 11) or the post-processing time $\beta 2$ ($\alpha<\beta 2$) (step S14 in the flowchart of FIG. 11). As a result, when it is determined that the arrival time $\alpha$ of the sheet at the stop position is shorter than the post-processing time $\beta 1$ ($\alpha<\beta 1$) (YES in step S6 in the flowchart of FIG. 11) or the post-processing time $\beta 2$ ($\alpha<\beta 2$) (YES in step S14 in the flowchart of FIG. 11), the post-processing operation is started on the preceding sheet (step S7 for the intermediate operation type or step S15 for the long operation type in the flowchart of FIG. 11). Then, the conveyance of the subsequent sheet is temporarily stopped (step S8 for the intermediate operation type or step S16 for the long operation type in the flowchart of FIG. 11). That is, in this case, if the subsequent sheet is conveyed without stopping, it is likely that the subsequent sheet enters the post-processing apparatus before the post-processing operation on the preceding sheet finishes.

Further, when it is determined that the type of the post-processing operation is the long operation type, in addition to the temporary stop of the conveyance of the subsequent sheet, the driving of the drying device including the power on (heating) of the heater is stopped and the image forming operation is stopped (step S16 in the flowchart of FIG. 11). Thereafter, when the post-processing operation on the preceding sheet finishes (step S9 for the intermediate operation type and step S17 for the long operation type in the flowchart of FIG. 11), the subsequent sheet is conveyed again (step S10 for the intermediate operation type and step S18 for the long operation type in the flowchart of FIG. 11). In a case in which the image forming operation and the drying operation have not been performed, the subsequent sheet is conveyed after these operations have been performed on the preceding sheet. Further, when it is determined that the type of the post-processing operation is the long operation type, the drying device that has been stopped is driven again and the image forming operation is started again (step S18 in the flowchart of FIG. 11).

On the other hand, when it is determined that the arrival time $\alpha$ of the sheet at the stop position is equal to or longer than the post-processing time $\beta 1$ or the post-processing time $\beta 2$ (NO in step S6 for the intermediate operation type and step S14 for the long operation type in the flowchart of FIG. 11), the post-processing operation on the preceding sheet finishes before the subsequent sheet enters the post-processing apparatus even if the subsequent sheet cannot be temporarily stopped. Therefore, the subsequent sheet is conveyed without stopping, the image forming operation and the drying operation are performed on the subsequent sheet, and the subsequent sheet is conveyed to the post-processing apparatus (step S11 for the intermediate operation type and step S19 for the long operation type in the flowchart of FIG. 11).

Thereafter, it is confirmed whether or not there is any request of additional post-processing operation for the same type (step S12 for the intermediate operation type and step S20 for the long operation type in the flowchart of FIG. 11). When there is a request of additional post-processing operation (YES in step S12 for the intermediate operation type and step S20 for the long operation type in the flowchart of FIG. 11), the procedure goes back to step S6 for the intermediate operation type and step S14 for the long operation type to repeat the flows of the post-processing operation until there is no request of additional post-processing operation. On the other hand, when there is no request of additional post-processing operation (NO in step S12 for the intermediate operation type and step S20 for the long operation type in the flowchart of FIG. 11), the post-processing operation ends.

Thus, in the above-described example, even if the type of the post-processing operation is the short operation type, the intermediate operation type, or the long operation type, when the post-processing operation on the preceding sheet finishes before the subsequent sheet reaches the predetermined stop position, the subsequent sheet is not stopped so that the productivity of the image forming apparatus 100 (e.g., the number of output images per unit time) is enhanced. On the other hand, by stopping the subsequent sheet at the predetermined stop position (in an area other than the heat area of the drying device 6), the subsequent sheet stands by at the predetermined stop position while the effect of heat from the drying device to the subsequent sheet is reduced, in other words, the subsequent sheet is less affected by heat from the drying device. In particular, in the case of the long operation type having a long post-processing time, by stopping the conveyance of the subsequent sheet and the power on of the heater of the drying device, wasteful energy consumption is reduced and the energy saving is enhanced.

As described above, the above-described configurations according to the embodiments of the present disclosure are applied but may not limited to the drying device having the configuration as illustrated in FIG. 4. For example, the present disclosure may be applicable to a drying device having a different configuration.

Next, a description is given of another drying device according to the present disclosure.

Figure 12:
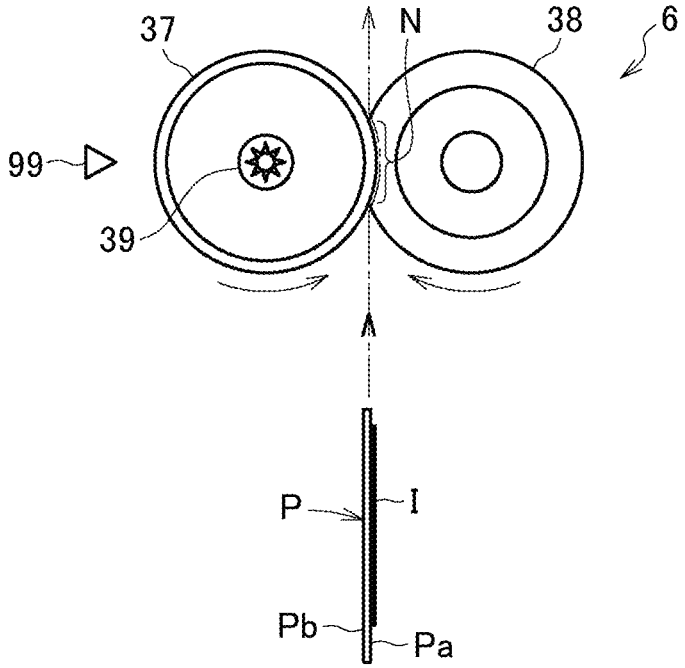
FIG. 12 is a diagram illustrating an example in which the position of a heat roller and the position of a pressure roller are reversed from the positions in the drying device of FIG. 4.

FIG. 12 is a diagram illustrating an example in which the position of the heat roller 37 and the position of the pressure roller 38 are reversed from the positions in the drying device 6 of FIG. 4.

Figure 13:
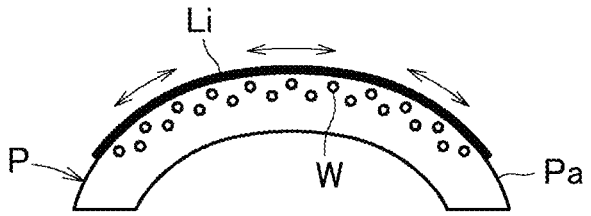
FIG. 13 is a diagram for explaining the principle of generation of a back curl on a sheet.

FIG. 13 is a diagram for explaining the principle of generation of a back curl on a sheet.

Figure 14:
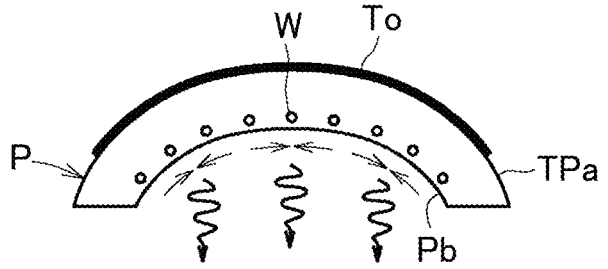
FIG. 14 is a diagram for explaining the principle of generation of a back curl on a sheet.

FIG. 14 is a diagram for explaining the principle of generation of another back curl on a sheet.

As illustrated in FIG. 12, the respective positions of the heat roller 37, the pressure roller 38, the heater 39, and the temperature sensor 99 are reversed from the positions in the drying device 6 of FIG. 4. Except for the above-described positions, the drying device 6 illustrated in FIG. 12 basically has the configuration identical to the configuration of the drying device 6 illustrated in FIG. 4.

In the case of the drying device 6 illustrated in FIG. 12, as the sheet P on which the ink I is applied enters the nip region N between the heat roller 37 and the pressure roller 38, the sheet P is heated mainly from the opposite face Pb opposite the liquid applied face (image forming surface) on which the ink I is applied. That is, the sheet P is heated from the opposite face Pb that contacts the heat roller 37 that is heated by the heater 39.

As described above, in the drying device 6 illustrated in FIG. 12, the sheet P is heated from the opposite face Pb that is opposite the liquid applied face Pa, thereby restraining generation of back curl on the sheet P.

Hereinafter, a description is given of the principle of back curl generation and the effect of restraining the back curl.

Generally, in a case of a plain paper, when liquid Li is applied to one side, that is, the liquid applied face Pa of the sheet P as illustrated in FIG. 13, water Win the liquid Li stretches fabric on the liquid applied face Pa of the sheet P in a specified direction, which generates a curl. More specifically, the water W permeates between the cellulose fibers of the sheet P and breaks the hydrogen bond of the cellulose fibers. By so doing, the intervals of the cellulose fibers increase, and therefore the sheet P extends in the specified direction. As a result, the sheet P warps upward to cause the image forming surface (liquid applied face Pa) to have a curl in a convex shape. The curl is referred to as a back curl.

Further, in an electrophotographic image forming apparatus that forms an image with toner, as the image forming surface of the sheet is heated to fix the toner to the sheet, a curl similar to the back curl may be generated. To be more specific, as illustrated in FIG. 14, when the image forming surface (toner applied face TPa) of the sheet P, to which toner To is applied, is heated with the higher temperature, the water content of the water W originally contained in the sheet P increases to be higher on the opposite face Pb than on the toner applied face TPa. As a result, the shrinkage of the sheet P caused by the subsequent drying after heating is more remarkable on the opposite face Pb than on the toner applied face TPa. This shrinkage causes the image forming surface (toner applied face TPa) of the sheet P to warp upward in a convex shape to generate a back curl.

That is, on the contrary to the example of a back curl illustrated in FIG. 14, in the drying device 6 illustrated in FIG. 12, the sheet P is heated from the opposite face Pb that is opposite the image forming surface (liquid applied face Pa) of the sheet P. That is, on the contrary to example of the back curl illustrated in FIG. 14, the opposite face Pb of the sheet P is heated at the temperature higher than the temperature of the liquid applied face Pa of the sheet P. Therefore, a force is exerted in the opposite direction to a force applied to the sheet P to generate the back curl. Accordingly, the drying device 6 illustrated in FIG. 12 restrains generation of back curl, thereby reducing or eliminating inconveniences such as a conveyance failure by the sheet having a back curl and a decrease in the number of sheets stackable in the sheet ejection tray.

Figure 15:
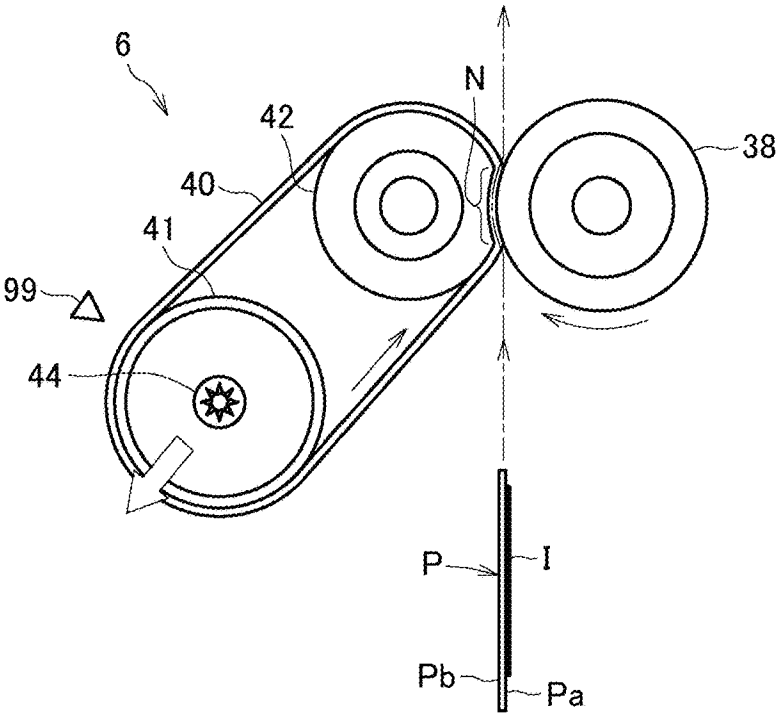
FIG. 15 is a diagram illustrating an example in which the drying device includes a heat belt.

Further, such an effect of restraining back curl is similarly obtained when drying the image on the back face of the sheet P in the duplex printing. That is, in a case in which the image formed on the back face of the sheet P is dried, the sheet P is heated from the opposite face Pb (front face) opposite the liquid applied face Pa (back face), so that the force is exerted in the opposite direction to the force that generates a back curl to the sheet P. Note that, since ink is applied to both the front and back faces of the sheet P in the duplex printing, both faces may be the "liquid applied face." However, the "liquid applied face" referred to in the description of the present disclosure represents the face on which liquid is applied (front face) when the sheet P has the liquid on a single face or the face on which liquid is applied for the second time (back face) when the sheet P has the liquid on both the front and back faces. FIG. 15 is a diagram illustrating an example in which the drying device 6 includes a heat belt as a heating member to heat the sheet.

To be more specific, the drying device 6 illustrated in FIG. 15 includes a heat belt 40, a tension roller 41, a fixed roller 42, the pressure roller 38, a heater 44, and the temperature sensor 99.

The heat belt 40 is a heating member to heat the sheet P while being in contact with the sheet P. In the present embodiment, the heat belt 40 includes an endless belt base having flexibility, an elastic layer formed on the outer circumferential surface of the belt base, and a release layer formed on the outside of the elastic layer. Note that the belt base may have a single layer. The belt base of the heat belt 40 is constructed of a heat resistant resin, made of polyimide (PI), has an outer diameter of 100 mm and a thickness in a range of from 10 μm to 70 μm, for example. The elastic layer is made of silicone rubber and has a thickness of in a range of from 100 μm to 300 μm, for example. The release layer is constructed of a fluororesin, for example. Further, the heat belt 40 is rotatably supported by the tension roller 41 and the fixed roller 42 while being wound around the tension roller 41 and the fixed roller 42.

The tension roller 41 and the fixed roller 42 are belt supports each rotatably supporting the heat belt 40. The tension roller 41 is movable inside the loop of the heat belt 40 and is pressed against the inner circumferential surface of the heat belt 40 by a biasing member such as a spring. On the other hand, the fixed roller 42 is fixed so as not to move.

The pressure roller 38 is a pressing member that is pressed against the fixed roller 42 via the heat belt 40. The pressure roller 38 is in contact with the outer circumferential surface of the heat belt 40. Thus, the nip region N is formed between the pressure roller 38 and the heat belt 40. The structure of the pressure roller 38 is substantially the same as the configuration of the heat roller illustrated in FIG. 4.

The heater 44 is a heat source to heat the heat belt 40. In the present embodiment, the heater 44 is disposed inside the tension roller 41. Therefore, as the heater 44 generates heat, the heat is transmitted to the heat belt 40 via the tension roller 41, so that the heat belt 40 is heated. Accordingly, the tension roller 41 in the present embodiment functions as a heating member (heat rotator) to heat the heat belt 40 with the heat generated by the heater 44 disposed inside the tension roller 41. In the present embodiment, a halogen heater is used as the heater 44. Further, a heat source that heats the heat belt 40 may be a radiant-heat-type heater that emits infrared rays such as a halogen heater or a carbon heater, or an electromagnetic-induction-type heat source.

Further, the temperature sensor 99 functions as a temperature detector to detect the surface temperature of the heat belt 40, in other words, the temperature of the outer circumferential surface of the heat belt 40. By controlling the output of the heater 44 based on the surface temperature of the heat belt 40 detected by the temperature sensor 99, the surface temperature of the heat belt 40 is controlled to be a desired temperature (fixing temperature).

In the drying device 6 illustrated in FIG. 15, the pressure roller 38 rotates in the direction indicated by arrow in FIG. 15 (that is, a clockwise direction). By so doing, the heat belt 40, the tension roller 41, and the fixed roller 42 are rotated together with the rotation of the pressure roller 38. Note that the tension roller 41 and the fixed roller 42 each may be function as a drive roller. Further, the heater 44 generates heat to heat the heat belt 40 via the tension roller 41. The heater 44 is controlled to maintain the temperature of the heat belt 40 within a range, for example, from 100° C. to 180° C.

In this state, as illustrated in FIG. 15, as the sheet P on which the (liquid) ink I is applied is conveyed to the drying device 6, the sheet P enters (the nip region N) between the heat belt 40 and the pressure roller 38, so that the sheet P is held and conveyed by the heat belt 40 and the pressure roller 38. At this time, the sheet P is heated mainly by application of heat of the heat belt 40 and is ejected from the nip region N between the heat belt 40 and the pressure roller 38.

As described above, since the drying device 6 illustrated in FIG. 15 heats the sheet P mainly by heat from the heat belt 40, the sheet P is heated from the opposite face Pb that is opposite the image forming surface (liquid applied face Pa) of the sheet P, similar to the drying device 6 illustrated in FIG. 14. Accordingly, the force is exerted in the opposite direction opposite the direction of the force to generate a back curl on the sheet P, thereby restraining generation of a back curl.

Figure 16:
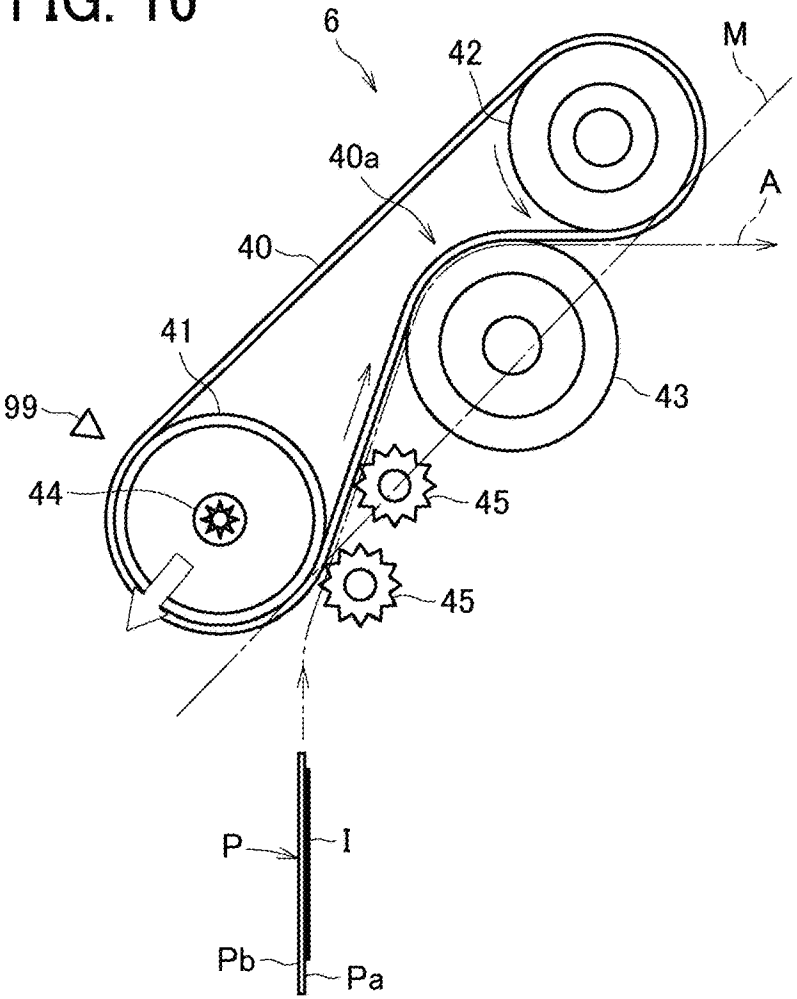
FIG. 16 is a diagram illustrating an example in which the drying device includes a pressure roller pressing the heat belt.

FIG. 16 is a diagram illustrating an example in which the drying device 6 includes a pressure roller pressing the heat belt 40.

Similar to the drying device 6 illustrated in FIG. 15, the drying device 6 illustrated in FIG. 16 includes the heat belt 40, the tension roller 41, the fixed roller 42, the heater 44, the temperature sensor 99, a pressure roller 43, and a plurality of spur wheels 45. However, the heat belt 40 has an outer diameter (for example, 150 mm) that is greater than the outer diameter of the heat belt 40 illustrated in FIG. 15.

The pressure roller 43 functions as a pressing member that presses the outer circumferential surface of the heat belt 40 between the tension roller 41 and the fixed roller 42. The pressure roller 43 is pressed against the heat belt 40 by a force applying member such as a spring and a cam, toward the inside of the heat belt 40, in other words, toward the inside of the loop of the heat belt 40, from a common tangent line M that contacts the outer circumferential surface of the tension roller 41 and the outer circumferential surface of the fixed roller 42. The pressure roller 43 presses the outer circumferential surface of the heat belt 40 toward the inside of the heat belt 40, so that the heat belt 40 has a curved portion 40*a* that warps (curves) along the outer circumferential surface of the pressure roller 43.

Each spur wheel 45 functions as a projecting rotator having a plurality of projections projecting radially outward.

Figure 17:
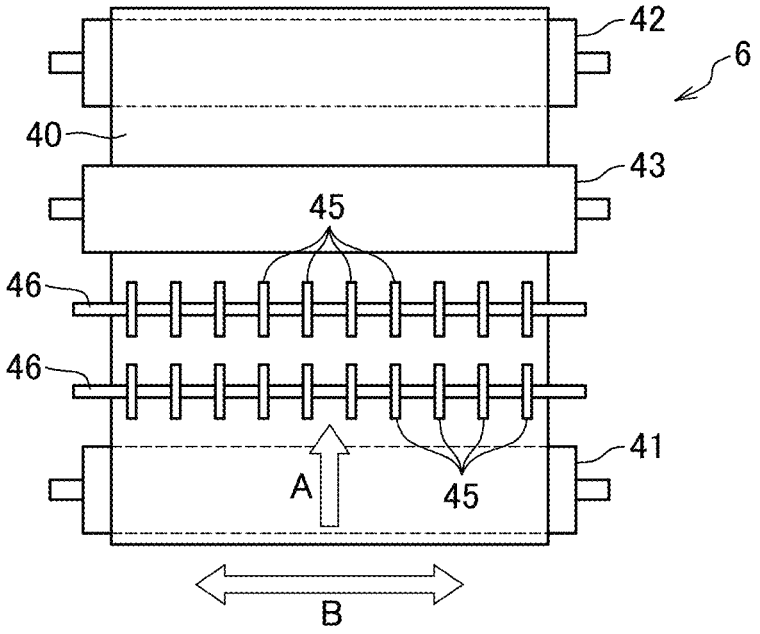
FIG. 17 is a plan view illustrating the drying device indicating the arrangement of the spur wheels.

Further, FIG. 17 is a plan view illustrating the drying device 6 indicating the arrangement of the spur wheels 45.

Figure 18:
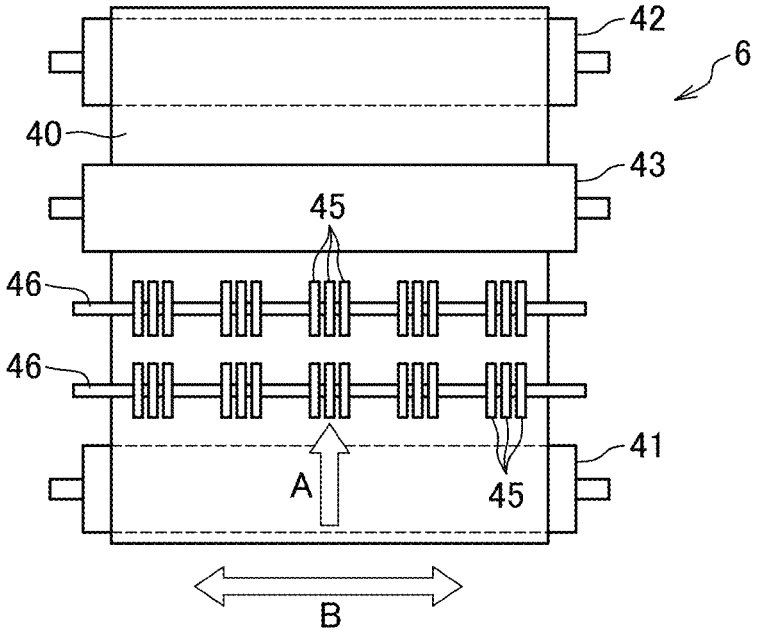
FIG. 18 is a plan view illustrating the drying device indicating another arrangement of spur wheels.

FIG. 18 is a plan view illustrating the drying device 6 indicating another arrangement of the spur wheels 45.

In the present embodiment, as illustrated in FIG. 17, a plurality of support shafts 46 are disposed along the sheet conveyance direction A. Further, the spur wheels 45 (plurality of spur wheels 45) are mounted on each of the plurality of support shafts 46, at equal intervals in the belt width direction indicated by arrow B in FIG. 17 or the axial direction of each support shaft 46. Here, the "belt width direction" represents a direction intersecting the sheet conveyance direction A along the outer circumferential surface of the heat belt 40. Further, FIG. 18 is a plan view illustrating the drying device 6 indicating another arrangement of the spur wheels 45. As illustrated in FIG. 6, the drying device 6 may include the spur wheel groups, in each of which the plurality of spur wheels 45 are disposed closely to each other, may be disposed at equal intervals over the belt width direction B. Further, the spur wheels 45 may be disposed at different intervals over the belt width direction B. Alternatively, the spur wheel 45 on the upstream side and the spur wheel 45 on the downstream side in the sheet conveyance direction A may not be at the same position in the sheet conveyance direction A but may be shifted from each other in the belt width direction B.

In the drying device 6 illustrated in FIG. 16, as the fixed roller 42 rotates in the direction indicated by arrow in FIG. 16 (that is, the counterclockwise direction), the heat belt 40 is rotated along with the rotation of the fixed roller 42, and the tension roller 41, the pressure roller 43, and the spur wheels 45 are rotated together with the rotation of the heat belt 40. Further, the heater 44 generates heat to heat the heat belt 40 via the tension roller 41, and the temperature of the heat belt 40 is maintained at the predetermined target temperature.

In this state, as illustrated in FIG. 16, as the sheet P on which a liquid ink I is applied is conveyed to the drying device 6, the sheet P first enters between the heat belt 40 and each of the spur wheels 45, so that the sheet P is conveyed by the heat belt 40 while the heat belt 40 rotates. At this time, the sheet P is heated by the heat belt 40, mainly from the opposite face Pb that is opposite the liquid applied face Pa of the sheet P. By so doing, the force is exerted in the opposite direction opposite the direction to which the force is applied to the sheet P to generate the above-described back curl.

Then, as the sheet P enters the nip region formed between the pressure roller 43 and the heat belt 40, the sheet P is conveyed by the pressure roller 43 and the heat belt 40 while the pressure belt 48 and the heat belt 40 are holding the sheet P. At this time, the sheet P is heated by the heat belt 40 from the opposite face Pb opposite the liquid applied face Pa and is conveyed while being warped so that the liquid applied face Pa forms a concave shape when the sheet P passes the curved portion 40*a* of the heat belt 40. That is, by passing through the curved portion 40*a* of the heat belt 40, the sheet P is warped in the direction opposite the back curl direction (the warping direction in which the liquid applied face Pa has the convex shape, in other words, the outwardly warped shape) over the sheet conveyance direction A.

As described above, in the drying device 6 illustrated in FIG. 16, the sheet P is heated from the opposite face Pb that is opposite the liquid applied face Pa and is further warped in the direction opposite the back curl direction, thereby effectively restraining generation of back curl on the sheet P.

Further, since the plurality of spur wheels 45 is disposed upstream from the pressure roller 43 in the sheet conveyance direction A in the drying device 6 illustrated in FIG. 16, the sheet P is guided by the plurality of spur wheels 45 before the sheet P reaches the pressure roller 43. At this time, even if the ink applied on the sheet P is in the liquid state, since the contact area of the spur wheel 45 or the plurality of spur wheels 45 to the liquid applied face Pa is smaller than the contact area of a generally used sheet conveying roller, ink smudge on the sheet P caused by the contact of the spur wheel 45 or the plurality of spur wheels 45 to the sheet P is prevented. Further, application of ink to the spur wheel 45 is reduced, so as to restrain the sheet from smear caused by ink being applied from the spur wheel 45 to another sheet.

Further, since the sheet P is guided by the spur wheel 45 to contact the heat belt 40, the sheet P contacts the heat belt 40 before reaching the pressure roller 43, which accelerates the drying of ink on the sheet P. Accordingly, when the sheet P contacts the pressure roller 43, distortion in the image is restrained. Further, after the sheet P has reached the pressure roller 43, the pressure roller 43 presses the sheet P against the heat belt 40 so that the sheet P closely contacts the heat belt 40. Accordingly, the heat is effectively supplied to the sheet P due to the close contact of the sheet P to the heat belt 40, and therefore the drying of the ink on the sheet P is further accelerated.

In addition, in the drying device 6 illustrated in FIG. 16, the heater 44 is disposed upstream from the pressure roller 43 (or the curved portion 40*a*) in the sheet conveyance direction A. Therefore, the sheet P is effectively heated on the upstream side from the pressure roller 43 in the sheet conveyance direction A. Accordingly, the drying of the ink on the sheet P is accelerated before the sheet P reaches the pressure roller 43 and ink application to the pressure roller 43 is restrained effectively.

In the drying device 6 illustrated in FIG. 16, the plurality of spur wheels 45 are disposed upstream from the pressure roller 43 in the sheet conveyance direction A. Therefore, as the sheet P is conveyed to the drying device 6 while the sheet P is deformed due to cockling, for example, the plurality of spur wheels 45 conveys the sheet P while holding the sheet P in a flat shape on the heat belt 40. Accordingly, the sheet P enters in a flat shape between the pressure roller 43 and the heat belt 40, thereby restraining occurrence of wrinkles on the sheet P.

Note that the plurality of spur wheels 45 may not contact the outer circumferential surface of the heat belt 40. As long as the sheet P is conveyed while being held in a flat shape without waving on the heat belt 40, the spur wheel 45 or the plurality of spur wheels 45 may be disposed close to the outer circumferential surface of the heat belt 40 (indirectly contacting the outer circumferential surface of the heat belt 40 via a gap). In other words, as long as a good conveyability of sheets is obtained, the spur wheel 45 or the plurality of spur wheels 45 may be in contact with the heat belt 40 or without contacting the heat belt 40.

Further, in the drying device 6 illustrated in FIG. 16, the pressure roller 43 is not pressed against each of the tension roller 41 and the fixed roller 42 via the heat belt 40, in other words, is spaced away from each of the tension roller 41 and the fixed roller 42. That is, the pressure roller 43 contacts the heat belt 40 at the position away from the tension roller 41 and the fixed roller 42 relative to the heat belt 40 in the sheet conveyance direction A. Therefore, occurrence of wrinkles on the sheet P caused by pressing the sheet P strongly is restrained. That is, since no nip region is formed by application of pressure by the pressure roller 43 and another roller on the sheet conveyance passage of the heat belt 40, the sheet P is not strongly pressed (in the nip region) between the rollers, thereby restraining occurrence of wrinkles on the sheet P. Further, the load to be applied to the heat belt 40 when the heat belt 40 is pressed (in the nip region) between the rollers is reduced, thereby enhancing the durability of the heat belt 40 and extending the service life of the heat belt 40. Further, the rotational resistance of the heat belt 40 is also reduced, thereby increasing the efficiency of rotation of the heat belt 40 and saving the driving energy.

Figure 19:
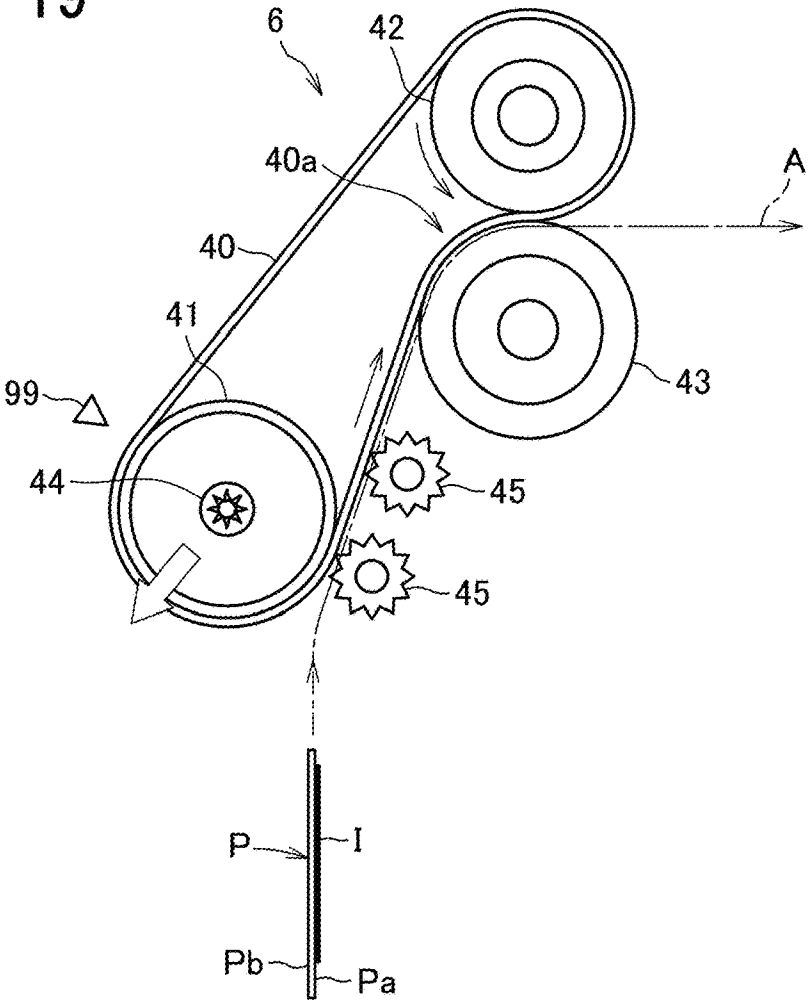
FIG. 19 is a diagram illustrating an example that the pressure roller contacts a fixed roller via the heat belt.

FIG. 19 is a diagram illustrating an example that the pressure roller 43 contacts the fixed roller 42 via the heat belt 40.

Figure 20:
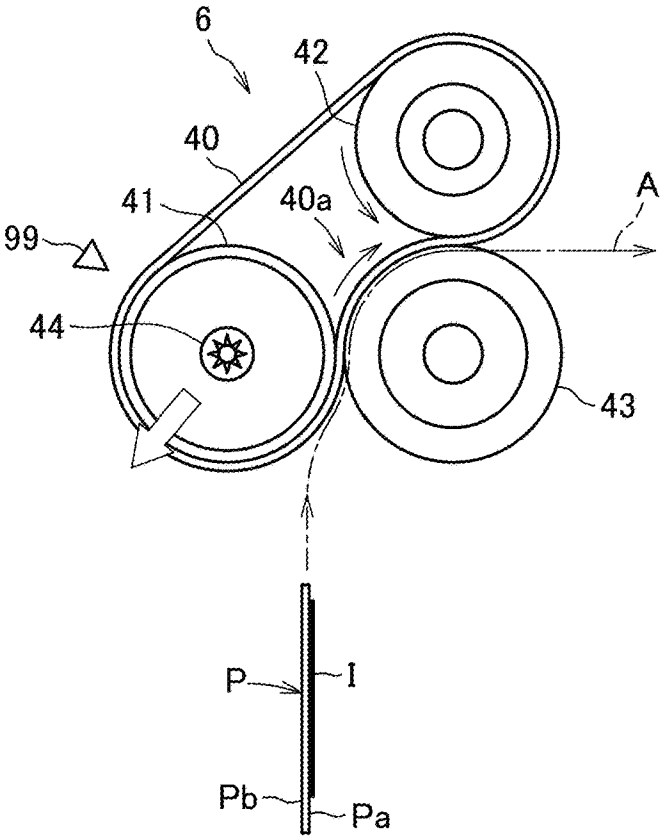
FIG. 20 is a diagram illustrating an example that the pressure roller contacts a tension roller and the fixed roller via the heat belt.

FIG. 20 is a diagram illustrating an example that the pressure roller 43 contacts the tension roller 41 and the fixed roller 42 via the heat belt 40.

As described above, in order to restrain occurrence of wrinkles on the sheet, it is preferable that the pressure roller 43 is not pressed in contact with another roller via the heat belt 40. However, other than this case, in order to restrain deformation of the sheet such as back curl more effectively, the pressure roller 43 may be pressed in contact with the fixed roller 42 via the heat belt 40, as illustrated in FIG. 19. Further, as illustrated in FIG. 20, the pressure roller 43 may be pressed in contact with each of the tension roller 41 and the fixed roller 42 via the heat belt 40.

Figure 21:
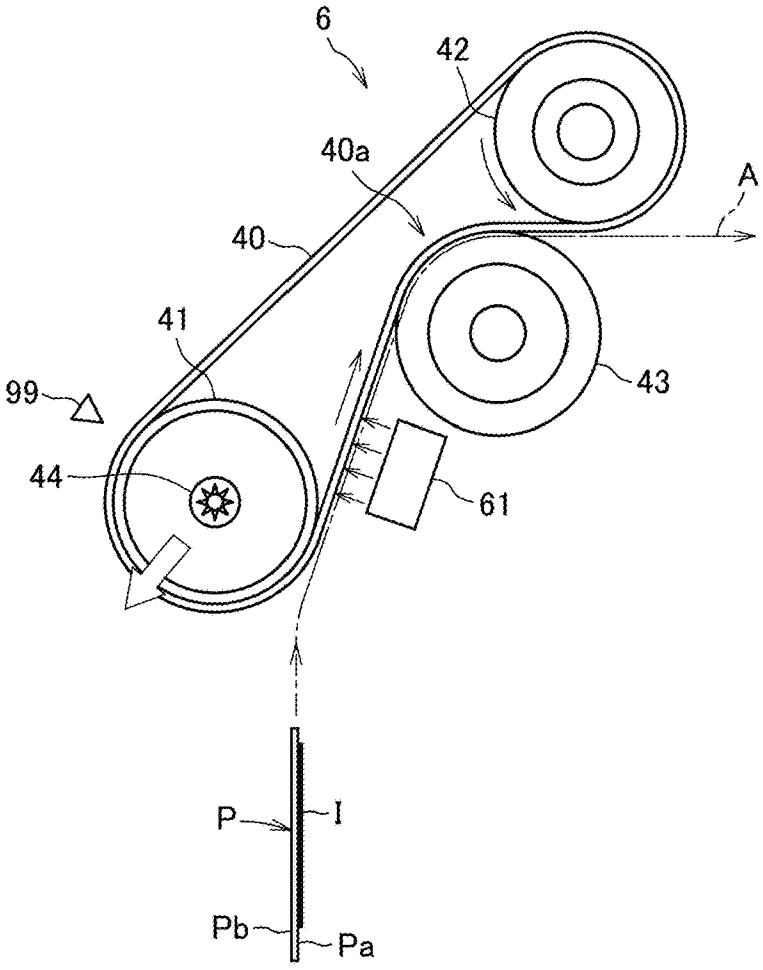
FIG. 21 is a diagram illustrating an example of an air blowing fan instead of the spur wheels.

FIG. 21 is a diagram illustrating an example of an air blowing fan 61 instead of the spur wheels 45.

As illustrated in FIG. 21, instead of the above-described spur wheel 45, the air blowing fan 61 that functions as an air blower may be employed as another device to restrain the image distortion and cause the sheet P to contact the heat belt 40. In this case, the air blowing fan 61 blows air to cause the sheet P to contact the heat belt 40, so that the sheet P is conveyed while being held in a flat shape without being pressed strongly. Further, the air blowing fan 61 may be a warm air blowing fan that blows warm air to restrain the heat belt 40 from being cooled.

Figure 22:
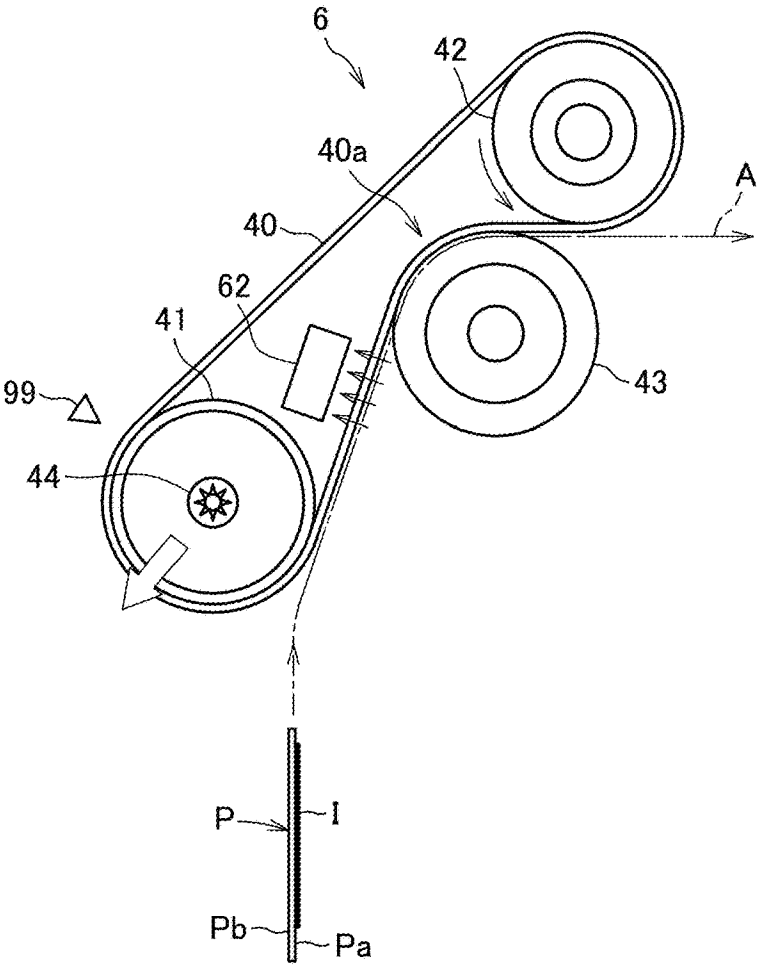
FIG. 22 is a diagram illustrating an example of an air suction fan instead of the spur wheels.

Further, FIG. 22 is a diagram illustrating an example of an air suction fan 62 instead of the spur wheels 45.

To be more specific, as yet another example, as illustrated in FIG. 22, the air suction fan 62 that functions as an air suction member may be disposed inside the loop of the heat belt 40. In this case, the heat belt 40 has a plurality of air holes and the air suction fan 62 sucks air from the plurality of air holes of the heat belt 40. By so doing, the sheet P is attracted to the heat belt 40. Accordingly, the sheet P is conveyed while being held in a flat shape on the heat belt 40 without being pressed strongly.

Further, in addition to the above-described methods using the air blowing fan 61 and the air suction fan 62, a method by which the heat belt 40 is charged to cause the sheet P to be electrostatically attracted to the charged heat belt 40 may be employed.

Figure 23:
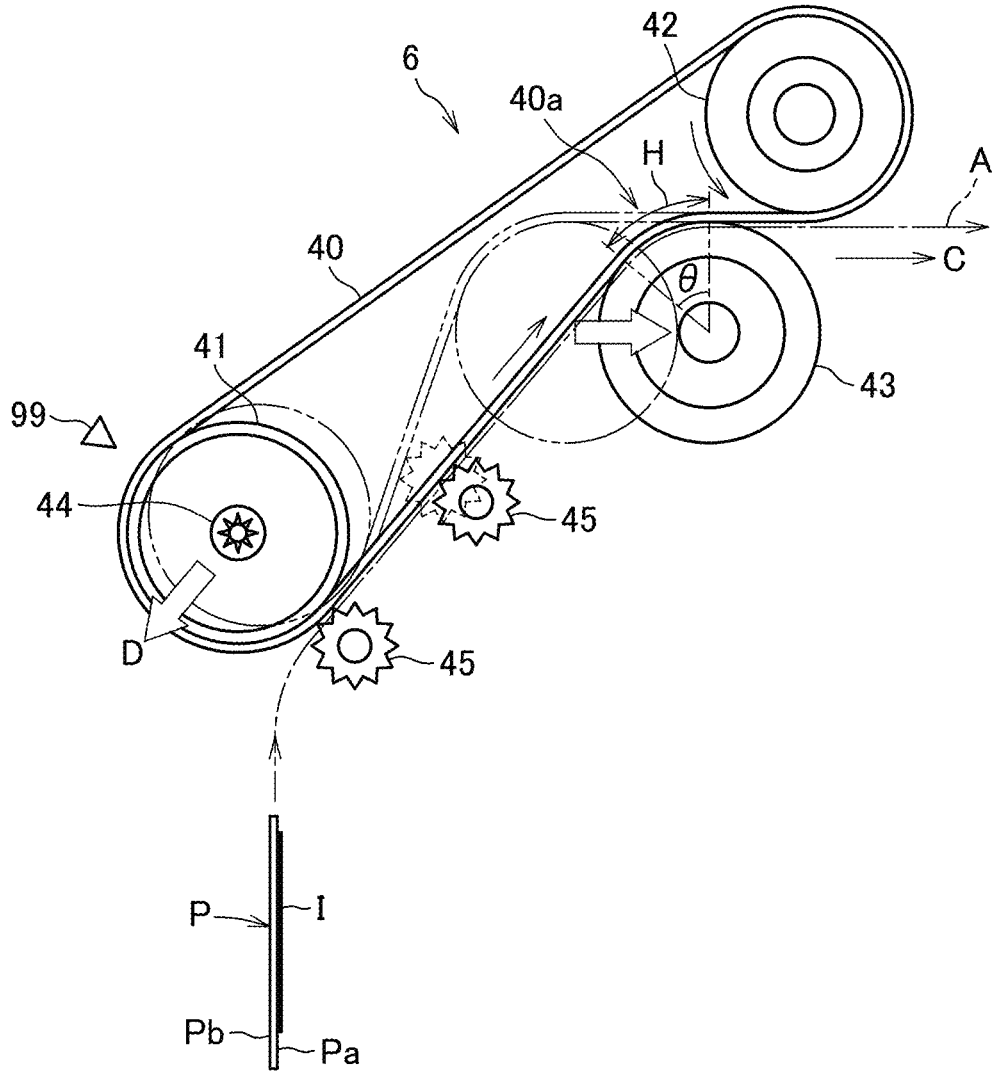
FIG. 23 is a diagram illustrating an example that the winding angle of the heat belt around the pressure roller is changeable.

FIG. 23 is a diagram illustrating an example that the winding angle of the heat belt 40 around the pressure roller 43 is changeable.

As illustrated in FIG. 23, the pressure roller 43 may be moved to make the winding angle θ of the heat belt 40 to the pressure roller 43 changeable. Accordingly, the length H of the contact area (curved portion 40*a*) in the sheet conveyance direction A, in which the pressure roller 43 and the heat belt 40 contact, is changeable.

For example, when an image having a low image area rate with texts, the amount of ink application to the sheet P is relatively small, and therefore it is not likely to generate back curl easily. Therefore, when an image having a low image area rate is formed on the sheet P, as illustrated in FIG. 23, the pressure roller 43 is moved to the right side in FIG. 23 to reduce the winding angle θ of the heat belt 40 to the pressure roller 43, so as to reduce the length H of the contact area in the sheet conveyance direction A. In this case, a decurling action performed when the sheet P passes the curved portion 40*a* of the heat belt 40 is decreased to apply a decurling force corresponding to the amount of curl of a possible back curl. Note that, in this case, a reduction in the length H of the contact area of the pressure roller 43 and the heat belt 40 in the sheet conveyance direction A decreases the time to heat the sheet P while the sheet P is pressed against the heat belt 40 by the pressure roller 43. That is, even though the amount of heat to be applied from the heat belt 40 to the sheet P is reduced, when the image area rate is relatively small and the amount of ink application to the sheet P is also relatively small, the time to heat the sheet P for drying may be relatively short. Therefore, the winding angle θ of the heat belt 40 to the pressure roller 43 may be reduced. Further, the amount of heat to be applied to the sheet P from the heat belt 40 decreases, the energy-saving effect is achieved.

Figure 29:
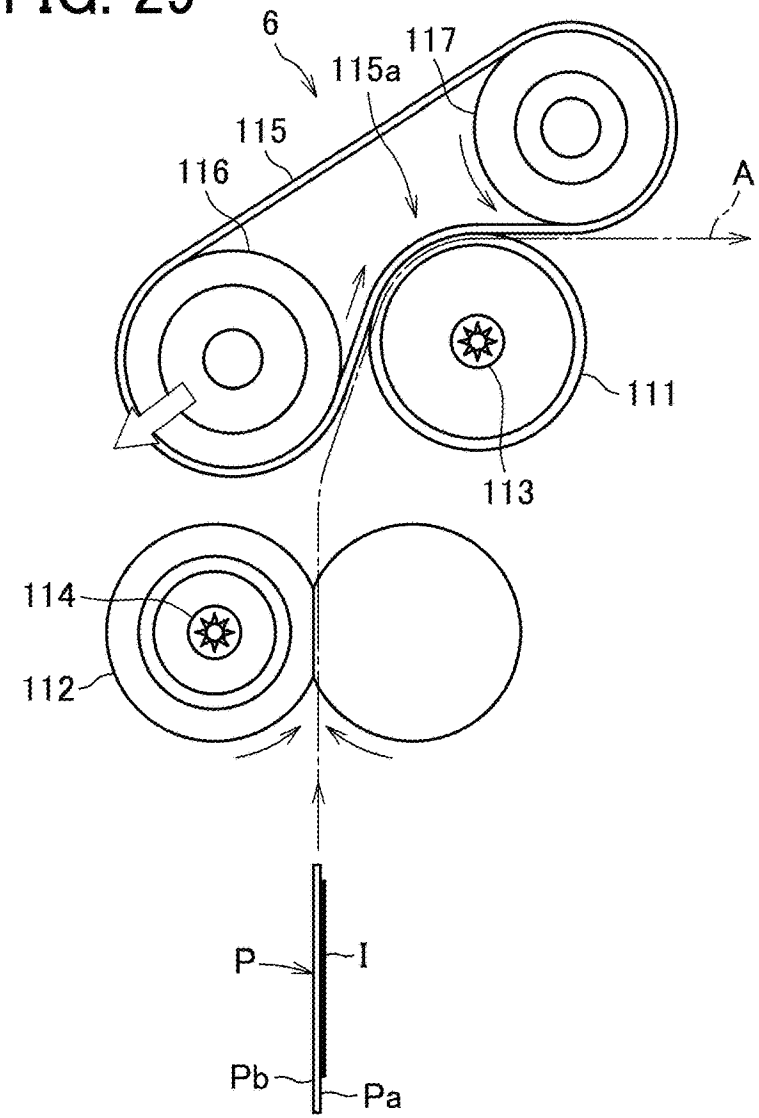
FIG. 29 is a diagram illustrating an example that a rotary body that contacts the first heat roller is a belt.

By contrast, when an image having a high image area rate and a high amount of ink application is formed, the pressure roller 43 is moved to the left side in FIG. 29 to increase the winding angle θ of the heat belt 40 to the pressure roller 43, so as to increase the length H of the contact area in the sheet conveyance direction A. Accordingly, the decurling action performed when the sheet P passes the curved portion 40*a* of the heat belt 40 is increased to effectively restrain deformation of the sheet such as back curl.

Further, when a relatively thick sheet P such as a thick paper is conveyed, if the winding angle θ is large, it is difficult to warp and convey the sheet P. Therefore, it is preferable to make the winding angle θ relatively small. By making the winding angle θ relatively small, even when the thick sheet P is conveyed, the sheet P is smoothly conveyed, and therefore occurrence of a conveyance failure may be prevented. As described above, by accordingly changing the winding angle θ depending on the thickness of the sheet and the amount of ink application to the above-described sheet, deformation of the sheet is effectively restrained and the conveyance performance and the energy-saving performance are enhanced.

Further, in addition to the above-described change of the winding angle θ of the heat belt 40, when the amount of ink application to the sheet P is relatively small, by reducing the amount of heat generation of the heater 44, the energy-saving performance is more enhanced when compared with a case in which the amount of ink application to the sheet P is relatively large.

Further, it is preferable that the direction of movement of the pressure roller 43 when changing the winding angle θ of the heat belt 40 is parallel to the direction of the heat belt 40 extending downstream from the pressure roller 43 in the sheet conveyance direction A (i.e., the direction indicated by arrow C in FIG. 23). By so doing, even when the pressure roller 43 is moved, the sheet ejection direction of the sheet P from the drying device 6 may not be changed, thereby ejecting the sheet P reliably. Further, in the drying device 6 according to the present embodiment, as the sheet P passes the curved portion 40*a* of the heat belt 40, the sheet conveyance direction of the sheet P is changed. That is, by employing a belt member having the curved portion, the sheet P is changed to the desired sheet conveyance direction easily to convey the sheet P.

Further, as illustrated in FIG. 23, as the pressure roller 43 moves, the tension roller 41 moves together with the pressure roller 43, so that the tension applied to the heat belt 40 is adjusted to the predetermined value. At this time, by setting the direction of movement of the tension roller 41 to the direction obliquely downward to the left (direction indicated by arrow D in FIG. 23) and the direction opposite the direction obliquely downward to the left, the spur wheel 45 at the extreme upstream position in the sheet conveyance direction A and the heat belt 40 are continuously in contact with each other and maintain the contact state without moving the spur wheel 45 at the extreme upstream position. Accordingly, the entrance position and entrance angle at which the sheet P enters between the extreme upstream spur wheel 45 and the heat belt 40 in the sheet conveyance direction A do not change, and the entrance of the sheet P may be made reliably.

Figure 24:
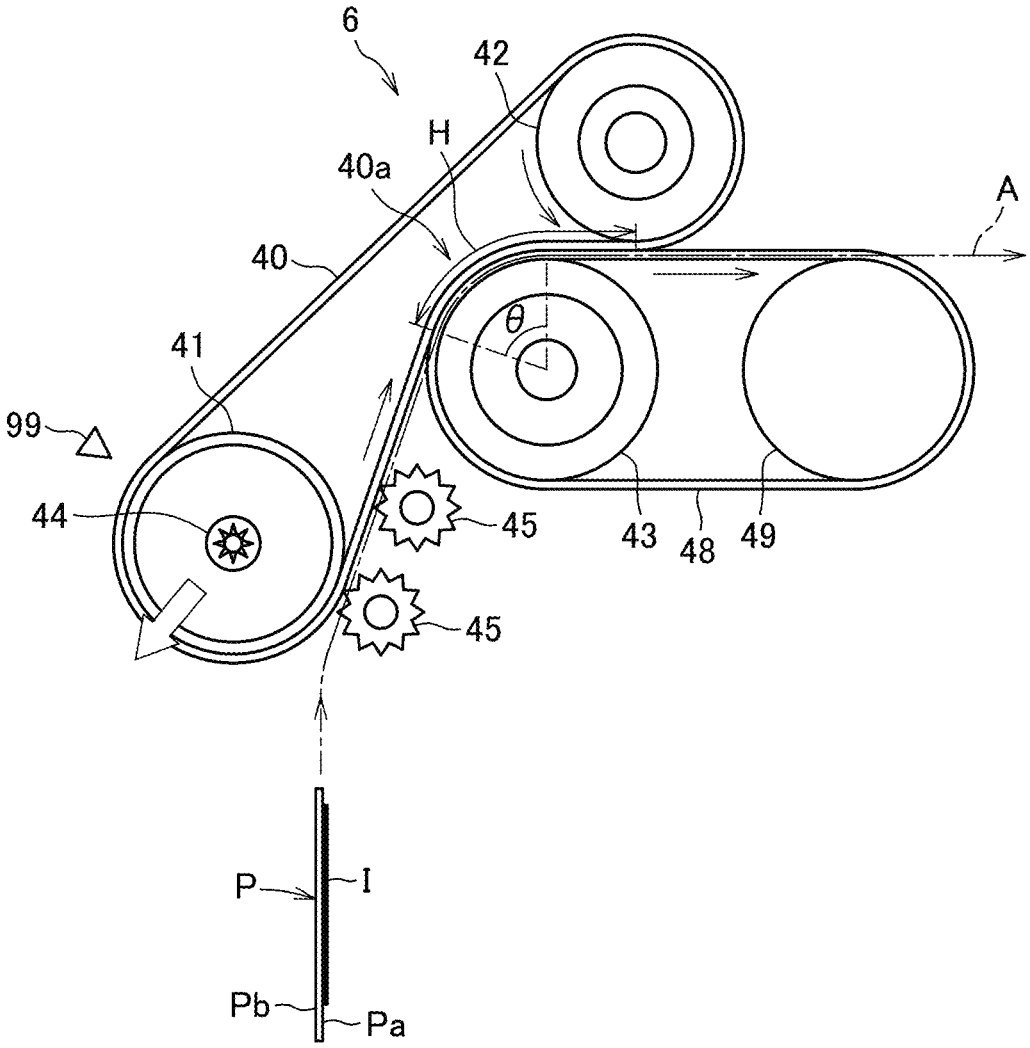
FIG. 24 is a diagram illustrating an example in which the drying device includes a pressure belt.

Further, FIG. 24 is a diagram illustrating an example in which the drying device 6 includes a pressure belt 48.

The drying device 6 illustrated in FIG. 24 includes the pressure belt 48. In this example, the pressure belt 48 having an endless loop is wound around the pressure roller 43 and a support roller 49 that is disposed downstream from the pressure roller 43 in the sheet conveyance direction A. The drying device 6 illustrated in FIG. 24 basically has the configuration identical to the configuration of the drying device 6 illustrated in FIG. 16, except the drying device 6 illustrated in FIG. 24 has the heater 47 inside the pressure roller 43.

In the drying device 6 according to FIG. 24, since the pressure roller 43 is biased toward the heat belt 40 via the pressure belt 48, the pressure belt 48 is pressed against the heat belt 40. That is, in the present embodiment, the pressure roller 43 and the pressure belt 48 each of which functions as a pressing member to press the heat belt 40. Further, in the present embodiment, as the fixed roller 42 is driven to rotate, the heat belt 40, the tension roller 41, the pressure belt 48, the pressure roller 43, and the support roller 49 are rotated along with rotation of the fixed roller 42. Further, either the pressure roller 43 or the support roller 49 may function as a drive roller.

In this case, after having passed the spur wheel 45 and then entered between the heat belt 40 and the pressure belt 48, the sheet P is conveyed as the heat belt 40 and the pressure belt 48 rotate while the sheet P is held by the heat belt 40 and the pressure belt 48. At this time, the sheet P is warped in the direction opposite the curve direction of the back curl along the curved portion 40*a* of the heat belt 40. Therefore, generation of back curl is restrained effectively. Further, the drying device 6 according to the present embodiment employs two belts (the heat belt 40 and pressure belt 48) which are in contact with each other to convey the sheet P. Therefore, the area in which the two belts convey the sheet P while gripping (holding) the sheet P (i.e., the area indicated by H in FIG. 24) extends largely in the sheet conveyance direction A. Accordingly, the sheet P is heated effectively, and the drying of ink on the sheet P is further accelerated and deformation of the sheet P such as back curl is restrained effectively.

In addition, in the drying device 6 according to FIG. 24, the pressure belt 48 is disposed to extend not to the upstream side from the curved portion 40*a* of the heat belt 40 in the sheet conveyance direction A but to the downstream side from the curved portion 40*a* of the heat belt 40 in the sheet conveyance direction A. By so doing, the sheet P contacts the heat belt 40 before the sheet P contacts the pressure belt 48, thereby accelerating the drying of ink on the sheet P. Accordingly, the application of ink to the pressure belt 48 is restrained effectively.

Further, as the example of FIG. 23, the drying device 6 illustrated in FIG. 24 may allow the pressure roller 43 to move according to the amount of ink application to the sheet P. According to this configuration, the winding angle θ of the heat belt 40 to the pressure belt 48 is changed to change the length H of the contact area in the sheet conveyance direction A in which the pressure belt 48 and the heat belt 40 contact with each other.

Figure 25:
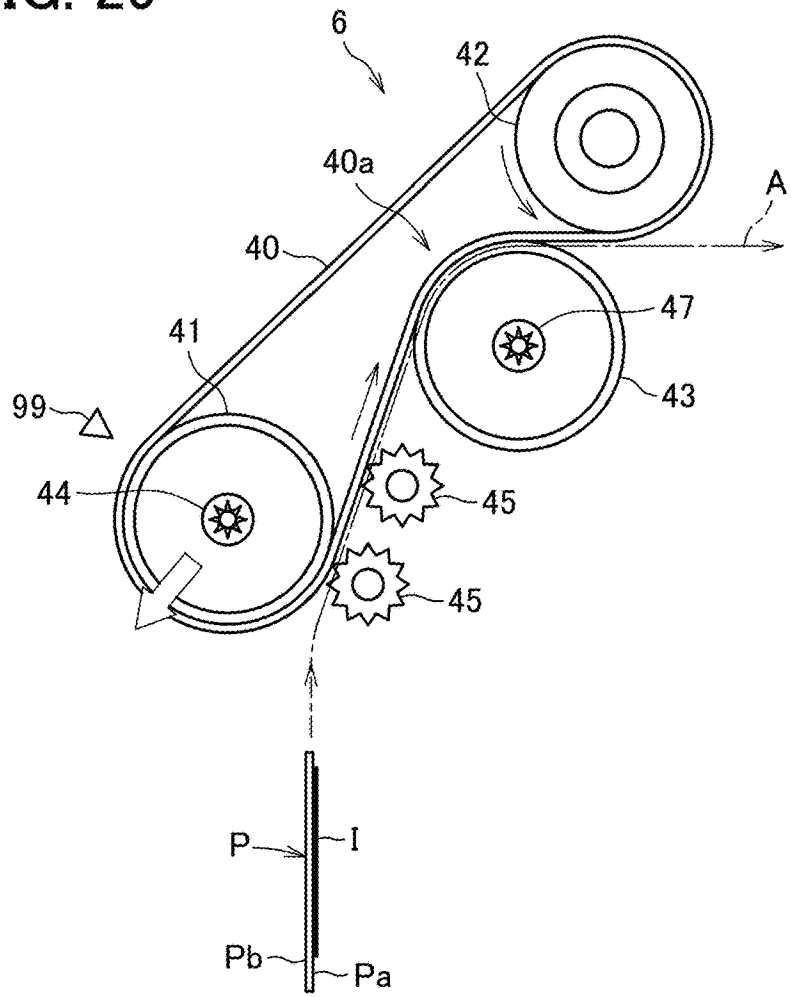
FIG. 25 is a diagram illustrating an example of the arrangement in which a heater is disposed inside the pressure roller.

FIG. 25 is a diagram illustrating an example of the arrangement in which a heater is disposed inside the pressure roller 43.

The drying device 6 illustrated in FIG. 25 is another example of the drying device 6 illustrated in FIG. 16 further including a heater 47 that functions as a heat source provided inside the pressure roller 43. The drying device 6 illustrated in FIG. 25 basically has the configuration identical to the configuration of the drying device 6 illustrated in FIG. 16, except the drying device 6 illustrated in FIG. 25 has the heater 47 inside the pressure roller 43.

In this case, the pressure roller 43 functions as a pressing member that presses the sheet P and as a heating member (heat rotator) that heats the sheet P. Therefore, when the sheet P passes the pressure roller 43, the sheet P is heated from the face that contacts the heat belt 40 (i.e., the opposite face Pb opposite the liquid applied face Pa) and the face that contacts the pressure roller 43 (i.e., the liquid applied face Pa) at the same time. Accordingly, the sheet P is heated effectively, and the drying of ink on the sheet P is further accelerated.

Further, in this case, the heat is applied to the face that contacts the heat belt 40 (i.e., the opposite face Pb opposite the liquid applied face Pa) longer than the face that contacts the pressure roller 43 (i.e., the liquid applied face Pa). Therefore, as the above-described embodiment, the opposite face Pb opposite the liquid applied face Pa of the sheet P is heated at the temperature higher than the temperature to the liquid applied face Pa. Accordingly, in this example, the force is exerted in the opposite direction opposite the force to generate a back curl on the sheet P, thereby restraining generation of the back curl. Further, in the configuration in which such a sheet P is heated from both sides (i.e., both the front and back faces), heat generation by the heater 44 and the heater 47 may be controlled in order to restrain generation of back curl more reliably.

Figure 26:
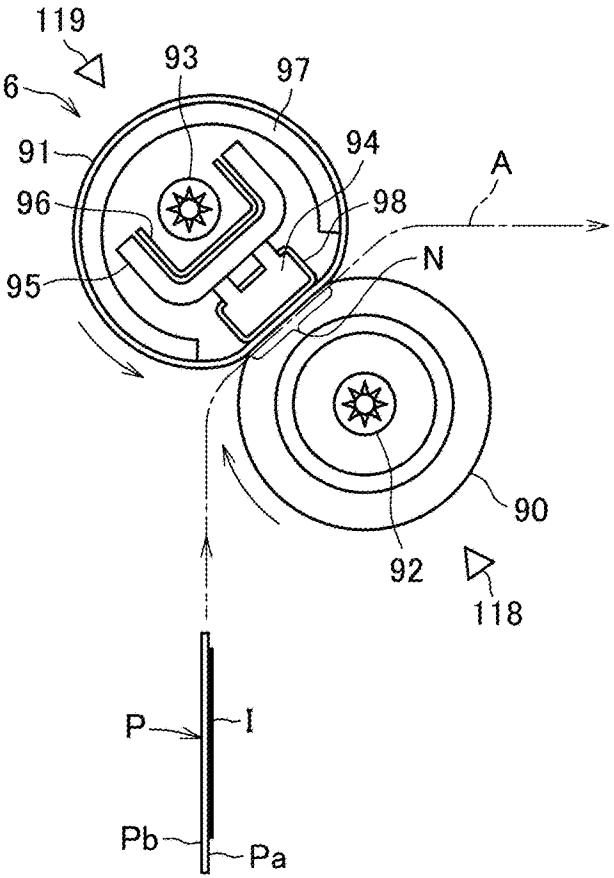
FIG. 26 is a diagram illustrating an example of controlling heat generation in each heater so that the opposite face that is opposite a liquid applied face of the sheet is heated at the higher temperature.

FIG. 26 is a diagram illustrating an example of controlling heat generation in each heater so that the opposite face Pb that is opposite the liquid applied face Pa of the sheet P is heated at the higher temperature.

The drying device 6 illustrated in FIG. 26 is an example that, by controlling heat generation in heaters 92 and 93, the opposite face Pb of the sheet P is heated at the temperature higher than the liquid applied face Pa of the sheet P.

To be more specific, the drying device 6 illustrated in FIG. 26 includes a heat roller 90, a heat belt 91, the heaters 92 and 93, a nip formation pad 94, a stay 95, a reflector 96, a belt support 97, and two temperature sensors 118 and 119.

The heat roller 90 functions a first heating member that heats the sheet P and is a cylindrical heat rotator. On the other hand, the heat belt 91 functions as a second heating member that heats the sheet P and is a cylindrical heat rotator that is a belt member radially thinner than the heat roller 90. The heat roller 90 is a roller similar to the pressure roller 38 illustrated in FIG. 17, and the heat belt 91 is a belt similar to the heat belt 40 illustrated in FIG. 15, except that the outer diameter of the heat belt 91 is smaller (for example, 30 mm) than the heat belt 40.

The heat roller 90 is biased by a pressing member such as a spring or a cam and is pressed against the nip formation pad 94 via the heat belt 91. Accordingly, the heat roller 90 is pressed against the heat belt 91, so that the nip region N is formed between the heat roller 90 and the heat belt 91. The nip formation pad 94 is preferably made of a heat-resistant resin material such as liquid crystal polymer (LCP) in order to prevent deformation due to application of heat and to form the nip region N having the stability.

Of the two heaters 92 and 93, the heater 92 is disposed inside the heat roller 90 and the heater 93 is disposed inside the heat belt 91. In the present embodiment, the heaters 92 and 93 each employs a halogen heater. A heat source included in the drying device 6 may be a radiant-heat-type heater that emits infrared rays such as a halogen heater or a carbon heater, or an electromagnetic-induction-type heat source.

In the present embodiment, in order to improve the slidability of the heat belt 91 with respect to the nip formation pad 94, a sheet-like sliding member (sliding sheet) 98 made of a low friction material such as PTFE is provided between the nip formation pad 94 and the heat belt 91. Further, in a case in which the nip formation pad 94 is made of a low friction material having slidability, the nip formation pad 94 may come into direct contact with the heat belt 91 without interposing the sliding member 98.

The stay 95 is a support that supports the nip formation pad 94 against the pressing force of the heat roller 90. Since the stay 95 supports the nip formation pad 94, the bending of the nip formation pad 94 is restrained, thereby forming the nip region N having the uniform width. Further, the stay 95 is preferably made of metal material such as SUS or SECC in order to have the good rigidity.

The reflector 96 reflects heat and light radiated from the heater. The reflector 96 is interposed between the heater 93 in the heat belt 91 and the stay 95 in the loop of the heat belt 91, so as to reflect the heat and light radiated from the heater 93 in the heat belt 91. Since the heat belt 91 receives light reflected by the reflector 96 in addition to light directly radiated from the heater 93. Therefore, the heat belt 91 is heated effectively. The reflector 96 is made of, e.g., aluminum or stainless steel.

The belt support 97 is a C-shaped or cylindrical member that supports the heat belt 91 from the inside. The belt support 97 is provided inside the heat belt 91, at both ends of the heat belt 91 in the rotational axis direction. With this configuration, the belt support 97 rotatably supports the heat belt 91. In particular, in the stationary state in which the heat belt 91 is not rotating, the heat belt 91 is basically supported in a state in which the tension is not generated in the circumferential direction of the heat belt 91.

Further, the temperature sensor 118 functions as a temperature detector to detect the surface temperature of the heat roller 90, in other words, the temperature of the outer circumferential surface of the heat roller 90. Similarly, the temperature sensor 119 functions as a temperature detector to detect the surface temperature of the heat belt 91, in other words, the temperature of the outer circumferential surface of the heat belt 91. The amount of heat generation of the heater 92 and the amount of heat generation of the heater 93 are controlled based on the temperatures detected by the temperature sensors 118 and 119, respectively, to make the surface temperature of the heat belt 91 to be higher than the surface temperature of the heat roller 90. Note that the positions of the temperature sensors 118 and 119 are not limited to the positions in FIG. 26 but may be respective positions near the nip start position of the heat roller 90 and the heat belt 91 (e.g., the entrance side of the sheet P to the nip region N). Further, respective temperature detectors may be detected to directly detect the temperatures of the heaters 92 and 93, so as to control the surface temperature of the heat belt 91 to be higher than the surface temperature of the heat roller 90 based on the temperatures detected by the temperature detectors.

In the drying device 6 illustrated in FIG. 26, as the heat roller 90 is driven to rotate in the direction indicated by arrow in FIG. 26 (i.e., the clockwise direction), the heat belt 91 is rotated along with rotation of the heat roller 90. Further, as the heaters 92 and 93 start to generate heat, the heat roller 90 and the heat belt 91 are heated. At this time, the amounts of heat generation of the heaters 92 and 93 are controlled based on the temperatures detected by the temperature sensors 118 and 119, respectively, to make the surface temperature of the heat belt 91 to be higher than the surface temperature of the heat roller 90.

In the state under the thus controlled temperature, as the sheet P enters the drying device 6 and is conveyed while being held by the heat belt 91 and the heat roller 90, the opposite face Pb of the sheet P that is opposite the liquid applied face Pa of the sheet P is heated by the heat belt 91 having the higher surface temperature. As a result, the opposite face Pb of the sheet P is heated at the temperature higher than the temperature of the liquid applied face Pa of the sheet P. Therefore, a force is exerted in the opposite direction to a force applied to the sheet P to generate the back curl. As described above, in the drying device 6 illustrated in FIG. 26, the amounts of heat generation of the heaters 92 and 93 are controlled. By so doing, the state in which the opposite face Pb of the sheet P is heated at the temperature higher than the liquid applied face Pa of the sheet P is achieved reliably, thereby restraining generation of back curl on the sheet P more effectively.

Figure 27:
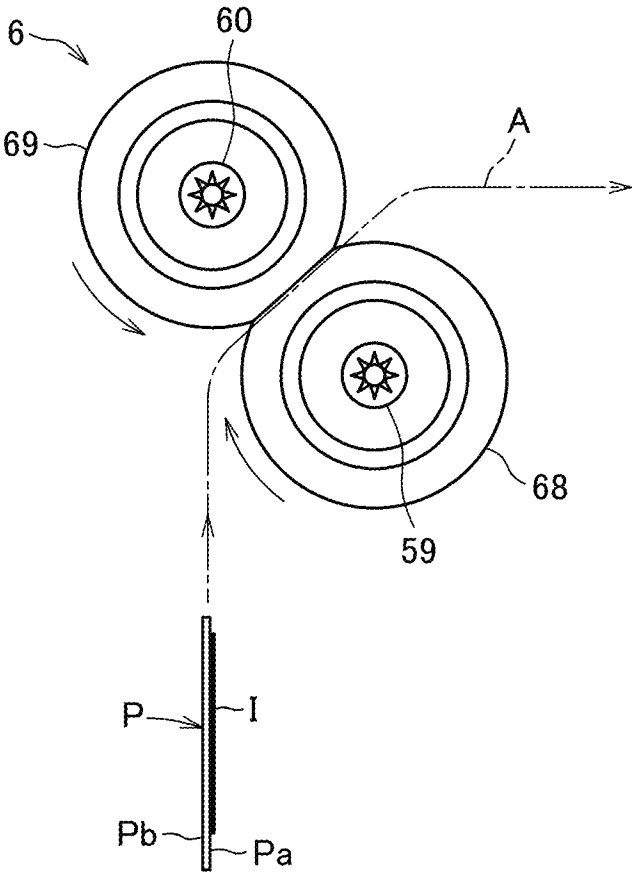
FIG. 27 is a diagram illustrating an example in which a first heating member and a second heating member are heat rollers in pair.

Further, FIG. 27 is a diagram illustrating an example in which a first heating member and a second heating member are heat rollers constructing a pair of heat rollers.

As illustrated in FIG. 27, the first heating member and the second heating member each heating the sheet P may be heat rollers 68 and 69. The heat rollers 68 and 69 contact (press) each other as a pair of heat rollers and have heaters 59 and 60 inside, respectively.

Figure 28:
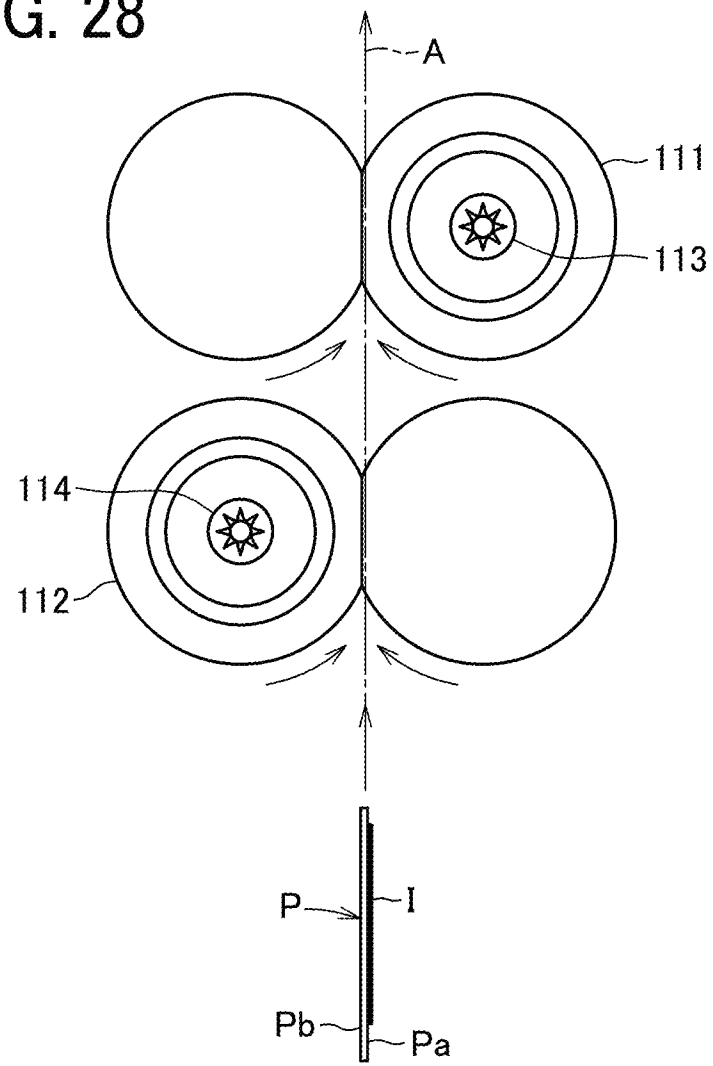
FIG. 28 is a diagram illustrating an example in which the first heating member and the second heating member do not contact with each other.

FIG. 28 is a diagram illustrating an example in which the first heating member and the second heating member do not contact with each other.

As the example illustrated in FIG. 28, the first heating member and the second heating member may not be disposed to contact with each other. In this example, a first heat roller 111 that functions as a first heating member having a heater 113 inside and a second heat roller 112 that functions as a second heating member having a heater 114 inside may be disposed at respective positions apart from each other in the sheet conveyance direction A so as not to contact with each other. In this case, in order that the opposite face Pb of the sheet P that is opposite the liquid applied face Pa of the sheet P is heated at the temperature higher than the liquid applied face Pa of the sheet P, the surface temperature of the second heat roller 112 is controlled to be higher than the surface temperature of the first heat roller 111.

However, in this case, in controlling the surface temperature of the second heat roller 112 to be higher than the surface temperature of the first heat roller 111, it is preferable to control the surface temperature in consideration of the following circumstances. That is, in the example illustrated in FIG. 28, after the sheet P has passed through the nip region of the second heat roller 112, the surface temperature of the sheet P decreases before the sheet P enters the nip region of the first heat roller 111. Therefore, the first heat roller 111 may need to heat the sheet P after the entrance of the sheet P to the nip region of the first heat roller 111, so that the temperature of the liquid applied face Pa of the sheet P does not become higher than the temperature of the opposite face Pb that is opposite the liquid applied face Pa of the sheet P. Therefore, it is preferable to control the temperature of the first heat roller 111 to be lower than the temperature of the opposite face Pb that is opposite the liquid applied face Pa of the sheet P when the sheet P enters the nip region of the first heat roller 111. By thus controlling the temperature of the first heat roller 111, the temperature of the opposite face Pb of the sheet P that is opposite the of the sheet P is maintained to be higher than the temperature of the liquid applied face Pa of the sheet P, so that back curl is restrained effectively.

FIG. 29 is a diagram illustrating an example that a rotary body that contacts the first heat roller 111 is a belt.

To be more specific, the roller that contacts the first heat roller 111 in the example illustrated in FIG. 28 may be replaced to a belt 115 having an endless loop as illustrated in FIG. 29. The belt 115 illustrated in FIG. 29 is wound with tension by two support rollers 116 and 117. Since the first heat roller 111 is pressed against the belt 115, the belt 115 has a curved portion 115*a* that curves along the outer circumferential surface of the first heat roller 111.

In this case, the opposite face Pb of the sheet P is heated at the temperature higher than the liquid applied face Pa of the sheet P and the decurling action is performed on the sheet P when the sheet P passes along the curved portion 115*a* of the belt 115. Therefore, generation of the back curl is restrained effectively.

Figure 30:
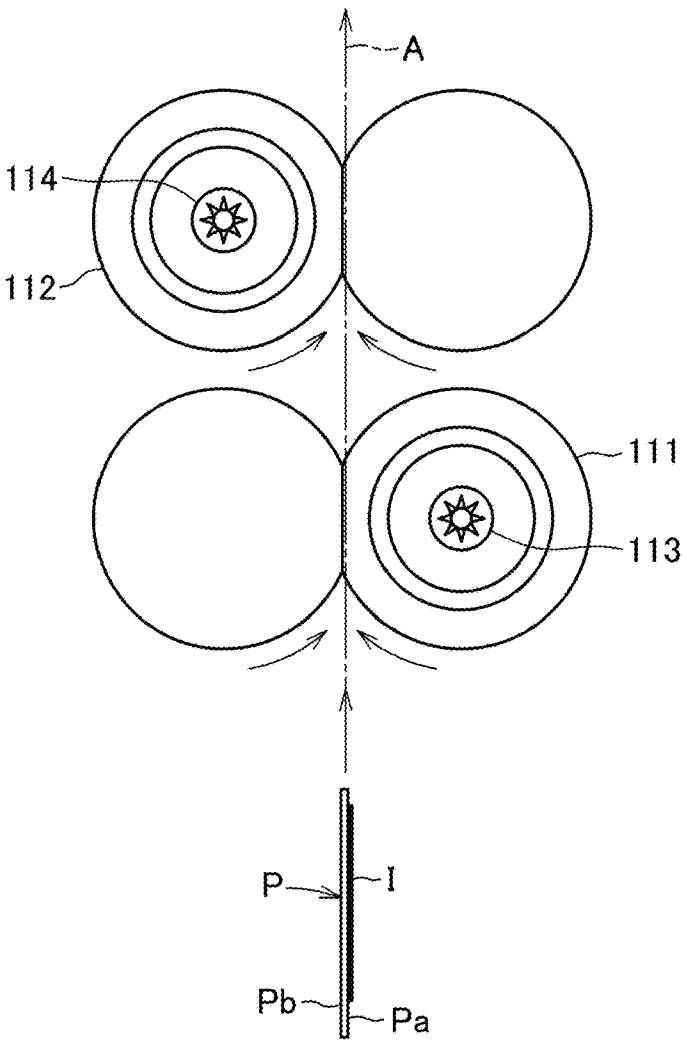
FIG. 30 is a diagram illustrating an example in which the order of the position of the first heat roller and the position of a second heat roller in a sheet conveyance direction are reversed from the order of the positions illustrated in FIG. 28.

FIG. 30 is a diagram illustrating an example in which the order of the position of the first heat roller 111 and the position of the second heat roller 112 in the sheet conveyance direction A are reversed from the order of the positions illustrated in FIG. 28.

As illustrated in FIG. 30, the order of the position of the first heat roller 111 and the position of the second heat roller 112 illustrated in FIG. 30 may be reversed from the order of the positions illustrated in FIG. 28, over the sheet conveyance direction A. That is, the first heat roller 111 may be disposed upstream from the second heat roller 112 in the sheet conveyance direction A. In this case, the sheet P first contacts the first heat roller 111, so that the liquid applied face Pa of the sheet P is heated. Then, as the sheet P contacts the second heat roller 112, the opposite face Pb that is opposite the liquid applied face Pa of the sheet P is heated. At this time, since the temperature of the second heat roller 112 is set to be higher than the temperature of the first heat roller 111, after the liquid applied face Pa of the sheet P is heated by the first heat roller 111, the opposite face Pb of the sheet P is heated by the second heat roller 112 at the higher temperature. Accordingly, the force is exerted in the opposite direction opposite the direction of the force to generate a back curl on the sheet P, thereby restraining generation of a back curl.

Figure 31:
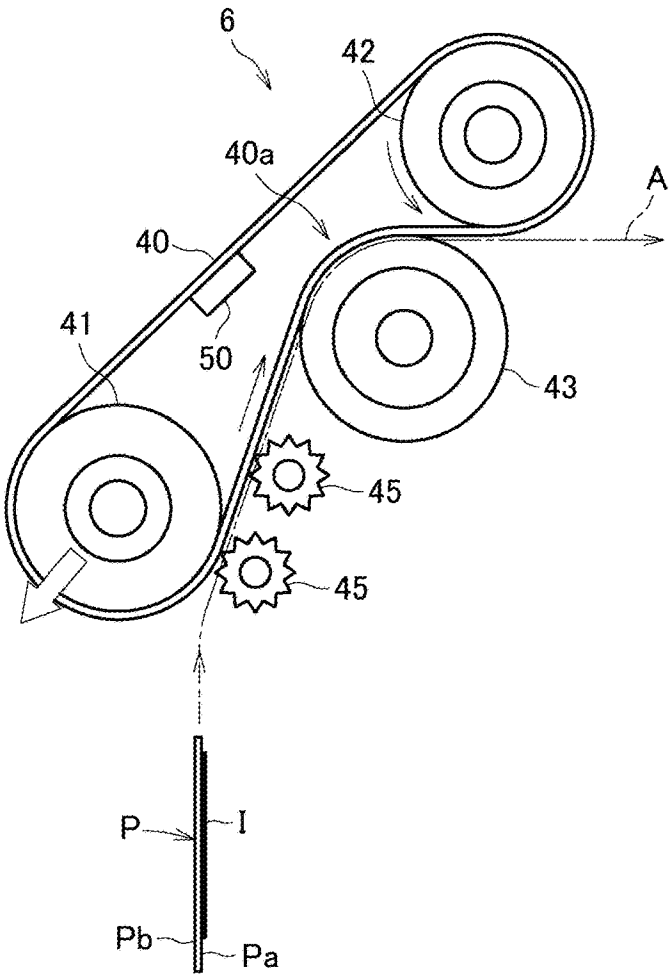
FIG. 31 is a diagram illustrating an example that a ceramic heater is employed to contact the heat belt.

Further, FIG. 31 is a diagram illustrating an example that a ceramic heater is employed to contact the heat belt.

The heater to heat the heat belt 40 illustrated in FIGS. 16 and 19 through 25 is not limited to the heater provided inside a roller but may be a ceramic heater 50 that contacts the inner circumferential surface of the heat belt 40 as illustrated in FIG. 31, for example. Further, the ceramic heater 50 may be disposed in contact with the outer circumferential surface of the heat belt 40. However, since the ceramic heater 50 relatively slides on the heat belt 40 while the heat belt 40 is rotating, in order to reduce the sliding resistance at this time, it is preferable that a slide sheet including a low friction material or a sheet metal such as aluminum having a slide coating to enhance the thermal conductivity efficiency may be inserted between the ceramic heater 50 and the heat belt 40.

Figure 32:
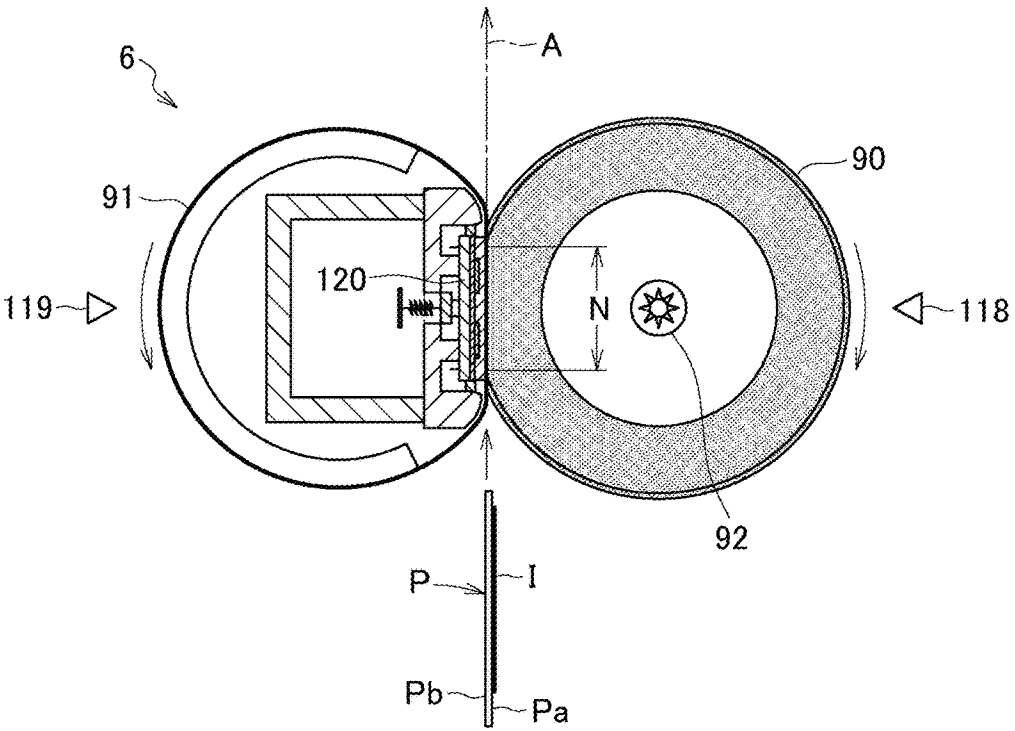
FIG. 32 is a diagram illustrating an example that a ceramic heater is employed to contact the heat belt at the nip region.

Further, FIG. 32 is a diagram illustrating an example that a ceramic heater is employed to contact the heat belt at the nip region.

As illustrated in FIG. 32, the heat source may be a ceramic heater 120 that contacts the heat belt 91 at the nip region N.

Figure 33:
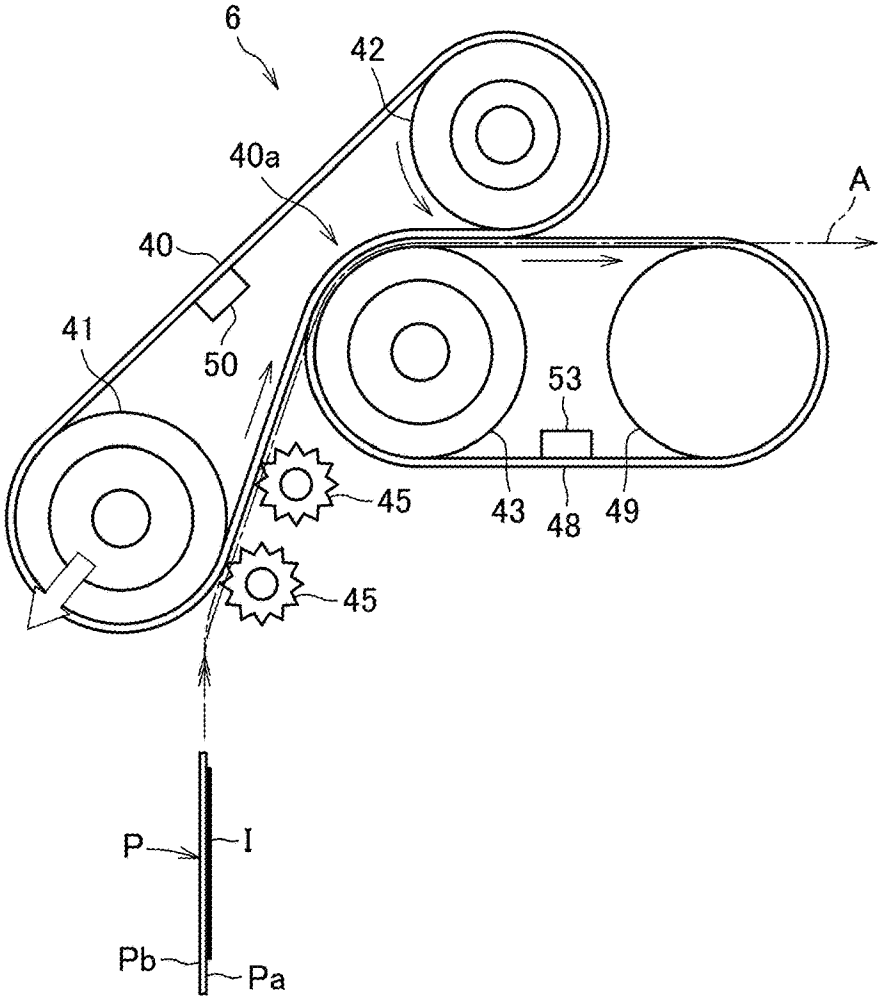
FIG. 33 is a diagram illustrating an example that a ceramic heater is employed to contact the pressure belt.

Furthermore, FIG. 33 is a diagram illustrating an example that a ceramic heater is employed to contact the pressure belt.

As illustrated in FIG. 33, a ceramic heater 53 that contacts the pressure belt 48 may be employed in addition to the ceramic heater 50 that contacts the heat belt 40.

Figure 34:
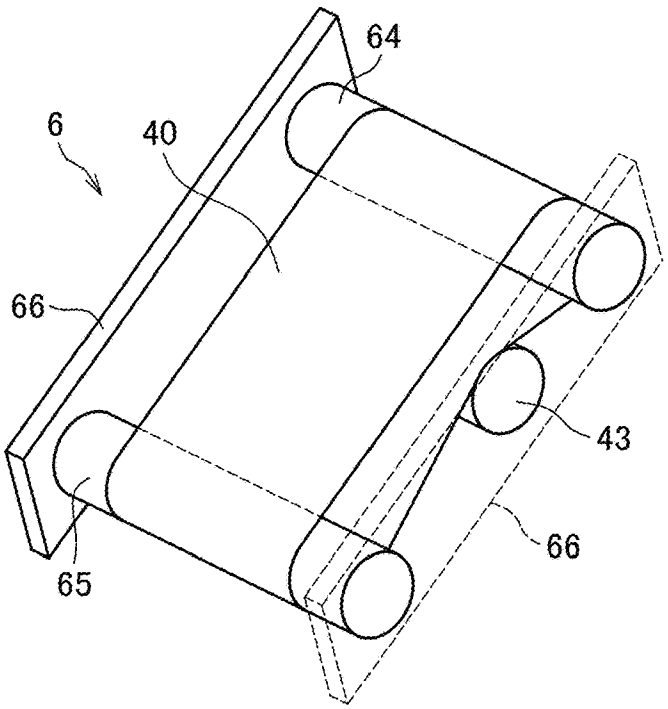
FIG. 34 is a diagram illustrating an example that the heat belt is supported by a belt support that does not rotate.

Further, FIG. 34 is a diagram illustrating an example that the heat belt is supported by a belt support that does not rotate.

The belt support that supports the heat belt 40 is not limited to a rotary body such as a roller and a belt. For example, as illustrated in FIG. 34, the heat belt 40 may be supported by a plurality of belt supports, which are a belt support 64 and a belt support 65. The belt supports 64 and 65 do not rotate. Further, each of the belt supports 64 and 65 may be constructed as separate parts or may be constructed as a single unit via a pair of frame members 66. In this case, as the pressure roller 43 is driven to rotate, the heat belt 40 is rotated along with rotation of the pressure roller 43 while sliding on the belt supports 64 and 65. At this time, it is preferable that each of the belt supports 64 and 65 includes a low friction material in order to reduce this sliding resistance between the heat belt 40 and each of the belt supports 64 and 65. Alternatively, a slide sheet that includes a low friction material may be provided between the heat belt 40 and the belt support 64 and between the heat belt 40 and the belt support 65.

Figure 35:
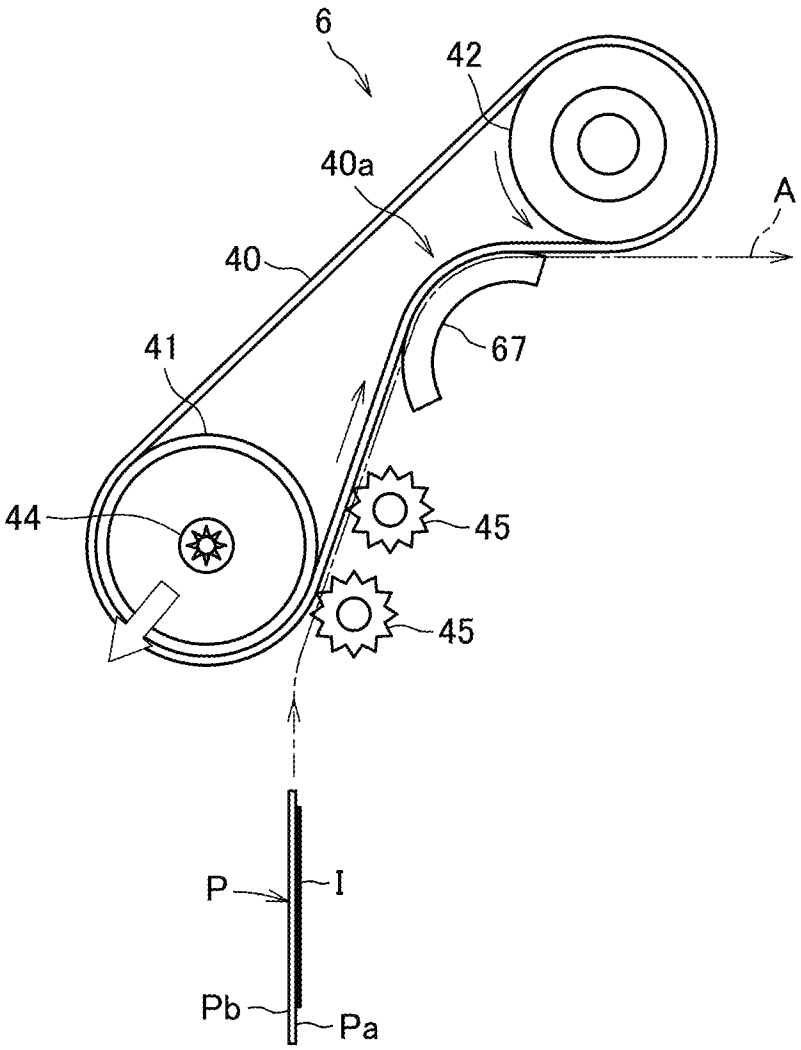
FIG. 35 is a diagram illustrating an example that the drying device employs a pressing pad that does not rotate.

Further, FIG. 35 is a diagram illustrating an example that the drying device 6 employs a pressing pad that does not rotate.

In the drying device (heating device) according to the present disclosure, the pressing member that presses the heat belt 40 to form the curved portion is not limited to a rotary body such as a pressure roller. For example, as the example illustrated in FIG. 35, the pressing member may be a pressing pad 67 that does not rotate and includes a ceramic heater having a curved surface. For example, in a case in which the liquid to be applied to the sheet is a processing liquid that does not form an image, even if the pressing pad 67 slides on the liquid applied face Pa of the sheet P, no problem of smear of the image does not occur. Therefore, the pressing pad 67 may be employed. Note that, also in this case, it is preferable to insert a slide sheet that includes a low friction material, between the heat belt 40 and the pressing pad 67, in order to reduce the sliding resistance that is generated between the heat belt 40 and the pressing pad 67.

Figure 36:
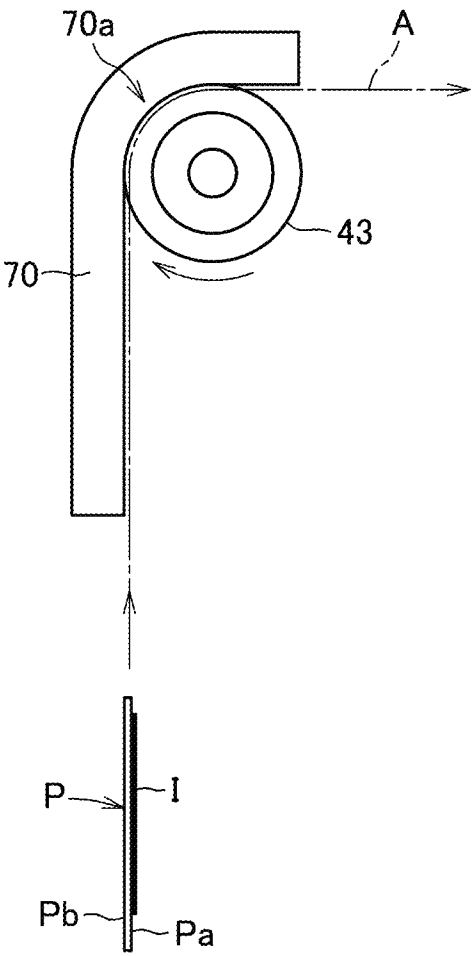
FIG. 36 is a diagram illustrating an example in which the drying device includes a heat guide.

Further, FIG. 36 is a diagram illustrating an example in which the drying device 6 includes a heat guide.

As illustrated in FIG. 36, instead of a rotary body such as the heat belt 40, a heat guide 70 that does not rotate may be employed. The heat guide 70 illustrated in FIG. 36 includes a curved portion 70*a* that warps the sheet P. As the pressure roller 43 rotates, the sheet P is conveyed while contacting the heat guide 70. At this time, the sheet P is heated by the heat guide 70 from the opposite face Pb that is opposite the liquid applied face Pa of the sheet P and is conveyed while being warped so that the liquid applied face Pa forms a concave shape when the sheet P passes the curved portion 70*a* of the heat guide 70, thereby restraining generation of back curl.

Figure 37:
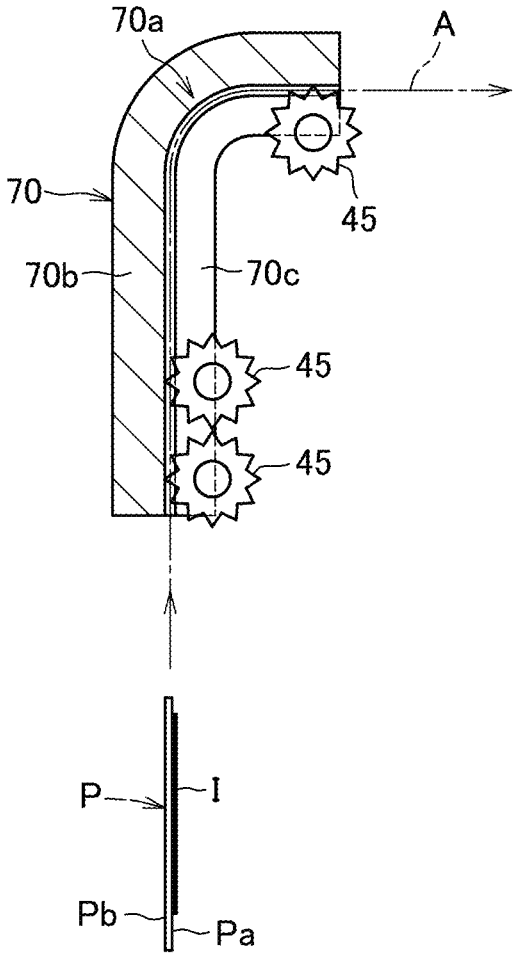
FIG. 37 is a diagram illustrating a heat guide according to a variation.

Further, FIG. 37 is a diagram illustrating a heat guide 70 according to a variation.

Figure 38:
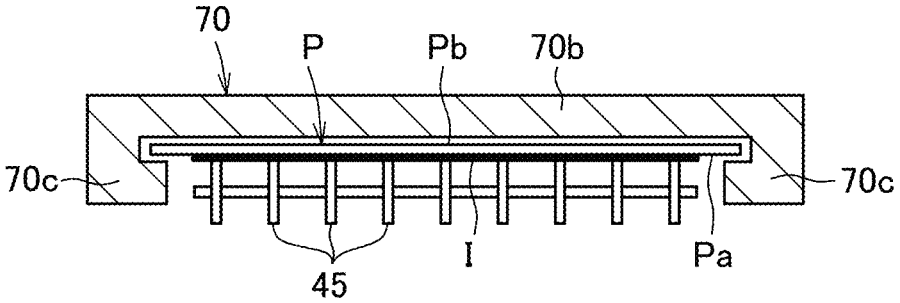
FIG. 38 is a cross sectional view illustrating the heat guide of FIG. 37 in the width direction of the sheet.

FIG. 38 is a cross sectional view illustrating the heat guide 70 of FIG. 37 in the width direction of the sheet.

The heat guide 70 may have a configuration illustrated in FIG. 37 or a configuration illustrated in FIG. 38. In this case, the heat guide 70 includes a main guide portion 70*b* and a pair of end guide portions 70*c*. The main guide portion 70*b* is disposed over the entire width direction of the sheet P. The end guide portions 70*c* are disposed at both lateral ends of the sheet P (both ends in the width direction of the sheet P). The main guide portion 70*b* is disposed facing the opposite face Pb that is opposite the liquid applied face Pa of the sheet P. Each of the pair of end guide portions 70*c* is disposed facing the corresponding lateral end of the sheet P (the corresponding end of the sheet P in the width direction) and the liquid applied face Pa at the corresponding lateral end of the sheet P. Further, in this case, the pressure roller 43 is not provided on the curved portion 70*a* of the heat guide 70. Instead of the pressure roller 43, the spur wheels 45 are provided upstream and downstream from the heat guide 70 in the sheet conveyance direction A.

In the embodiment illustrated in FIGS. 37 and 38, as the sheet P is conveyed to the heat guide 70, both ends in the width direction of the sheet P enter between the main guide portion 70*b* and each end guide portion 70*c*, so that the sheet P is guided by the main guide portion 70*b* and the end guide portions 70*c*. Further, the sheet P is conveyed while being held by the main guide portion 70*b* and the spur wheel 45 on the upstream side in the sheet conveyance direction A. Then, the sheet P passes the curved portion 70*a* of the heat guide 70. Thereafter, the sheet P is held and conveyed by the main guide portion 70*b* and the spur wheel 45 on the downstream side in the sheet conveyance direction A, and eventually the sheet is ejected. Also, in this case, the sheet P is heated from the opposite face Pb opposite the liquid applied face Pa and is warped so that the liquid applied face Pa is formed in a concave shape. By so doing, the deformation of the sheet P such as back curl is restrained effectively.

Even in the configuration provided with any of the drying devices described above, when the post-processing operation is performed on the preceding sheet, the subsequent sheet is stopped and stood by in an area other than the heating area of the drying device. By so doing, the subsequent sheet is less affected by heat from the drying device while the subsequent sheet is standing by. Further, in that case, when the drying device includes the heat belt and the heat guide described above, the contact area in which the heat belt or the heat guide contacts the sheet is heated, functioning as the heat area. Therefore, the area in which the subsequent sheet is stopped and stood by is any area other than the contact area of the heating member and the sheet.

Further, the present disclosure is applicable but not limited to a contact-heating-type drying device that includes a heating member that contacts the sheet to heat the sheet. For example, the present disclosure is also applicable to a non-contact-type drying device, e.g., a hot air generator that heats the sheet without directly contacting the sheet. For example, when the drying device is a hot air generator, the subsequent sheet may be stopped in an area other than the heat area in which warm air is blown to the sheet.

Figure 39:
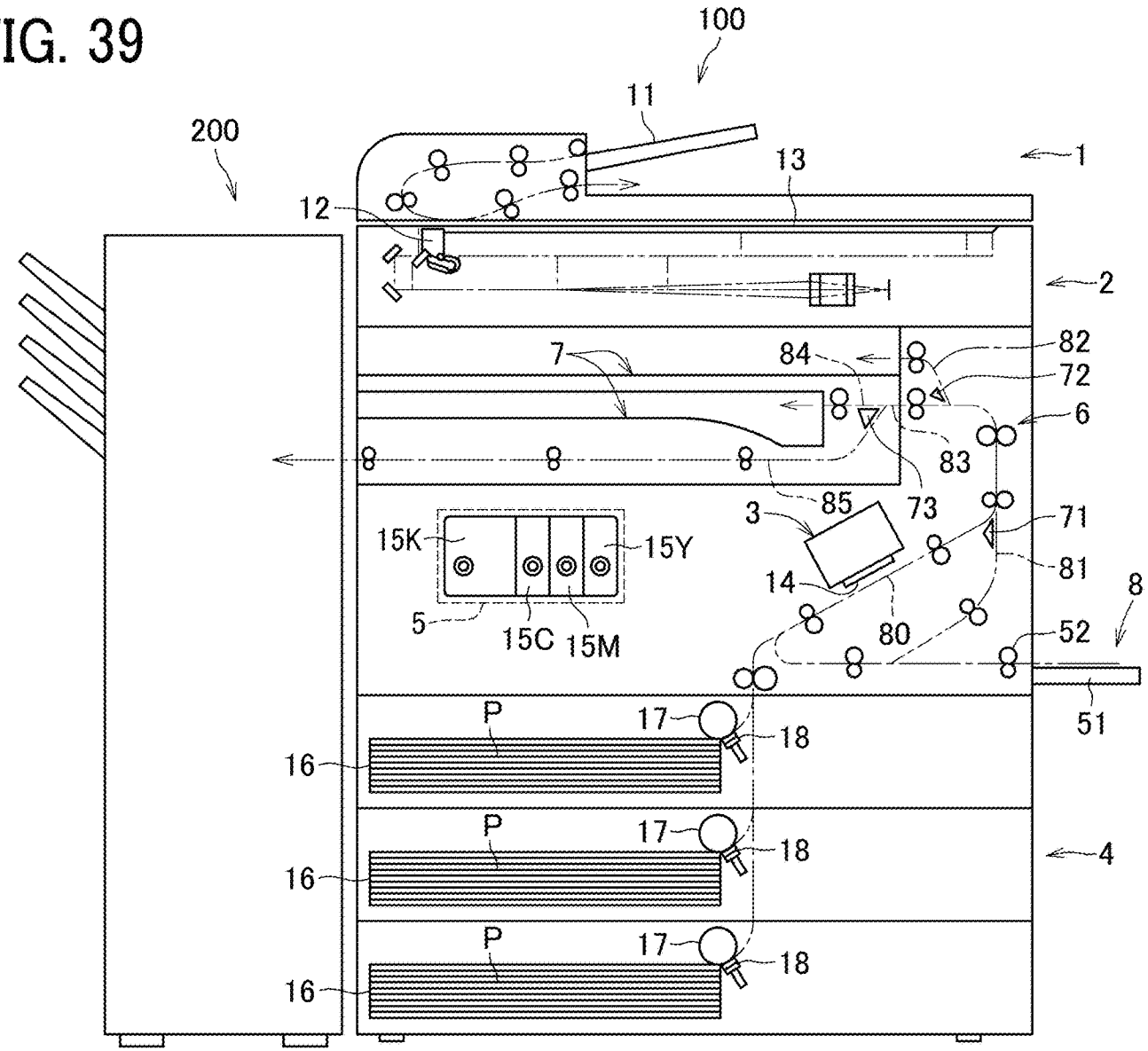
FIG. 39 is a diagram illustrating the configuration of another image forming apparatus.
Figure 40:
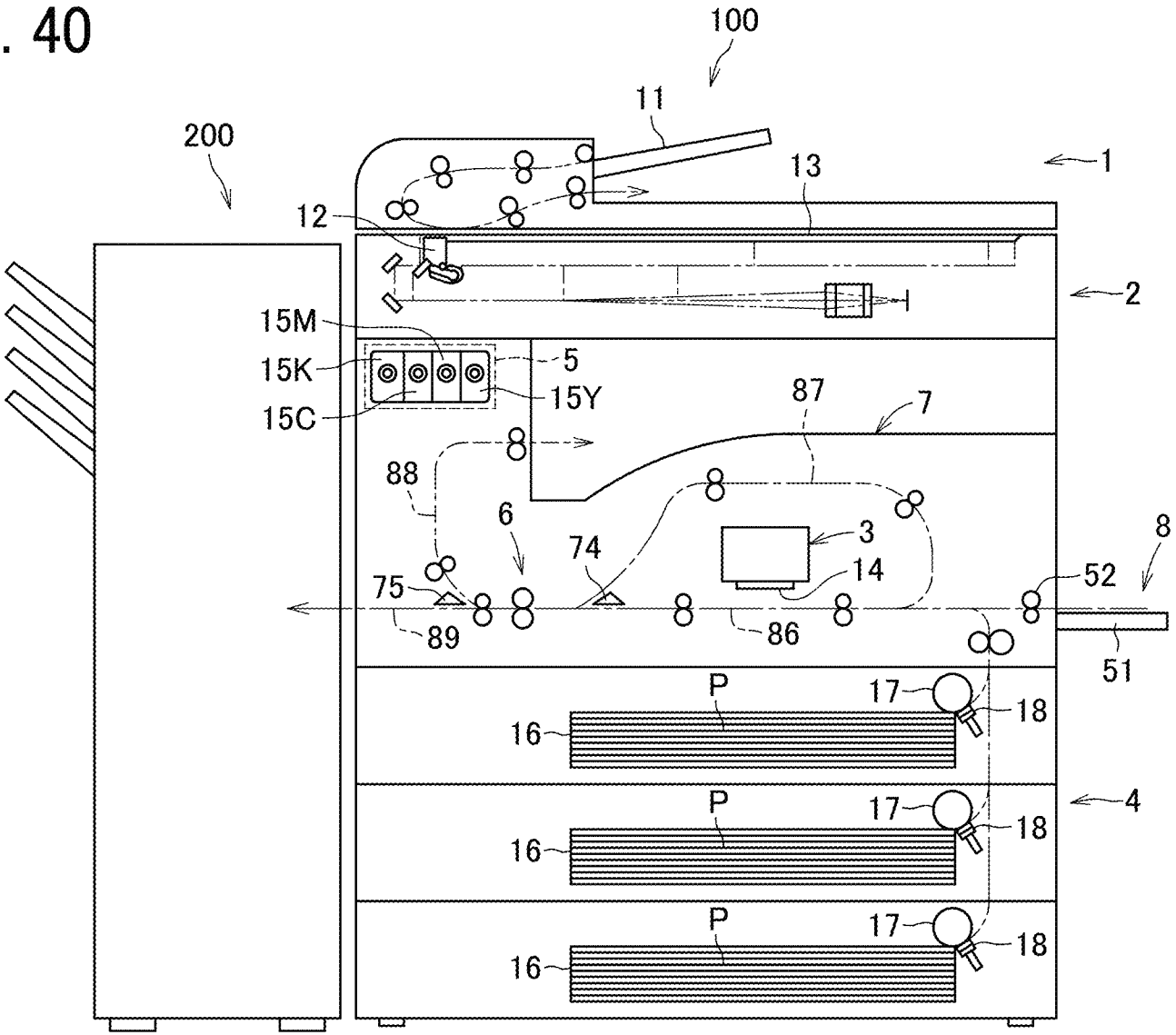
FIG. 40 is a diagram illustrating the configuration of yet another image forming apparatus.

Further, the drying device to which the present disclosure is applicable is not limited to the image forming apparatus illustrated in FIG. 1 but may be applicable to the image forming apparatus illustrated in FIG. 39 or the image forming apparatus illustrated in FIG. 40.

Next, a description is given of the configuration of the image forming apparatus 100 with reference to FIGS. 39 and 40.

FIG. 39 is a diagram illustrating the configuration of another image forming apparatus 100.

FIG. 40 is a diagram illustrating the configuration of yet another image forming apparatus 100.

Note that the following description is given of the configuration of the image forming apparatus 100 illustrated in FIGS. 39 and 40 different from the configuration of the above-described image forming apparatus 100. That is, the description of the configuration of the image forming apparatus 100 of FIGS. 39 and 40 that is same as the configuration of the image forming apparatus 100 according to the above-described embodiment, for example, the image forming apparatus 100 illustrated in FIG. 1, may be omitted.

Similar to the image forming apparatus 100 according to the above-described embodiments, the image forming apparatus 100 illustrated in FIG. 39 includes the original document conveying device 1, the image reading device 2, the image forming device 3, the sheet feeding device 4, the cartridge container 5, the drying device (heating device) 6, and the sheet ejection portion 7. Different from the image forming apparatus 100 according to the above-described embodiments, the image forming apparatus 100 illustrated in FIG. 39 further includes a bypass sheet feeding device 8. Different from the image forming device 3 in FIG. 1, the image forming device 3 in FIG. 39 is disposed facing a sheet conveyance passage 80 in which the sheet P is conveyed in a direction obliquely to the horizontal direction.

The bypass sheet feeding device 8 includes a bypass tray 51 and a bypass sheet feed roller 52. The bypass tray 51 functions as a sheet loader to load the sheet P. The bypass sheet feed roller 52 functions as a sheet feed body to feed the sheet P from the bypass tray 51. The bypass tray 51 is attached to open and close with respect to the housing of the image forming apparatus 100. In other words, the bypass tray 51 is rotatably attached to the housing of the image forming apparatus 100. When the bypass tray 51 is open (i.e., the state in FIG. 39), the sheet P or the bundle of sheets including the sheet P is loaded on the bypass tray 51 to feed the sheet P to the housing of the image forming apparatus 100.

In the image forming apparatus 100 illustrated in FIG. 39, as a print job start instruction is issued, the sheet P is supplied from the sheet feeding device 4 or from the bypass sheet feeding device 8 and is conveyed to the image forming device 3. Then, when the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 71 guides the sheet P to a sheet reverse passage 81. Then, as the sheet P passes the sheet reverse passage 81, the sheet P is reversed from the front face to the back face, and then is conveyed to the image forming device 3 again to form an image on the back face of the sheet P.

The sheet P having the image on one side or both sides is conveyed to the drying device 6 in which the ink on the sheet P is dried. Note that it is preferable that, when drying the ink on the front face of the sheet P and then forming an image on the back face of the sheet P, the drying device 6 dries the ink on the front face of the sheet P first, and then, the sheet P is conveyed in a sheet conveyance passage that detours the drying device 6. Then, it is also preferable that the direction of conveyance of the sheet P is switched back (changed) to the upstream side from the drying device 6 in the sheet conveyance direction, and the sheet P is guided to the image forming device 3 again via the sheet reverse passage 81. After the sheet P has passed the drying device 6, a second passage changer 72 guides the sheet P selectively to a sheet conveyance passage 82 that runs toward the upper sheet ejection portion 7 or to a sheet conveyance passage 83 that runs to the lower sheet ejection portion 7. In a case in which the sheet P is guided to the sheet conveyance passage 82 toward the upper sheet ejection portion 7, the sheet P is ejected to the upper sheet ejection portion 7. On the other hand, when the sheet P is guided to the sheet conveyance passage 83 toward the lower sheet ejection portion 7, a third passage changer 73 guides the sheet P selectively to a sheet conveyance passage 84 toward the lower sheet ejection portion 7 or to a sheet conveyance passage 85 toward the post-processing apparatus 200.

Then, when the sheet P is guided to the sheet conveyance passage 84 toward the lower sheet ejection portion 7, the sheet P is ejected to the lower sheet ejection portion 7. On the other hand, in a case in which the sheet P is guided to the sheet conveyance passage 85 toward the post-processing apparatus 200, the sheet P is conveyed to the post-processing apparatus 200, so that the post-processing operation is performed to the sheet P.

Similar to the image forming apparatus 100 illustrated in FIG. 39, the image forming apparatus 100 illustrated in FIG. 40 includes the original document conveying device 1, the image reading device 2, the image forming device 3, the sheet feeding device 4, the cartridge container 5, the drying device (heating device) 6, the sheet ejection portion 7, and the bypass sheet feeding device 8. Note that, in this case, similar to the image forming device 3 included in the image forming apparatus 100 in FIG. 1, the image forming device 3 included in the image forming apparatus 100 illustrated in FIG. 40 is disposed facing a sheet conveyance passage 86 in which the sheet P is conveyed in the horizontal direction.

In the image forming apparatus 100 illustrated in FIG. 40, as a print job start instruction is issued, the sheet P is supplied from the sheet feeding device 4 or from the bypass sheet feeding device 8 and is conveyed to the image forming device 3. Then, when the sheet P is conveyed to the image forming device 3, ink is discharged from the liquid discharge head 14 onto the sheet P to form an image on the sheet P.

When performing the duplex printing, after the sheet P has passed the image forming device 3, the sheet P is then conveyed in the opposite direction opposite the sheet conveyance direction. Then, a first passage changer 74 guides the sheet P to a sheet reverse passage 87. Then, as the sheet P passes the sheet reverse passage 87, the sheet P is reversed from the front face to the back face and is conveyed to the image forming device 3 again, so that an image is formed on the back face of the sheet P.

The sheet P having the image on one side or both sides is conveyed to the drying device 6 in which the drying operation of the ink on the sheet P is performed. At this time, when drying the ink on the front face of the sheet P and then forming an image on the back face of the sheet P, it is preferable that, after the drying device 6 has dried the ink on the front face of the sheet P first, the sheet P is conveyed in a sheet conveyance passage that detours the drying device 6. Then, it is also preferable that the direction of conveyance of the sheet P is switched back (changed) to the upstream side from the sheet conveyance passage 88 (upstream sides from the drying device 6) in the sheet conveyance direction, and the sheet P is guided to the image forming device 3 again via the sheet reverse passage 87. Then, after the sheet P is ejected from the drying device 6, a second passage changer 75 guides the sheet P selectively to a sheet conveyance passage 88 toward the sheet ejection portion 7 or to a sheet conveyance passage 89 toward the post-processing apparatus 200. When the sheet P is guided to the sheet conveyance passage 88 toward the sheet ejection portion 7, the sheet P is ejected to the sheet ejection portion 7. On the other hand, in a case in which the sheet P is guided to the sheet conveyance passage 89 toward the post-processing apparatus 200, the sheet P is conveyed to the post-processing apparatus 200, so that the post-processing operation is performed to the sheet P.

Even in the image forming apparatus 100 illustrated in FIG. 39 and the image forming apparatus 100 illustrated in FIG. 40, as in the above-described embodiments, when the post-processing operation is performed on the preceding sheet, the subsequent sheet is stopped and stood by in an area other than the heat area of the drying device 6. By so doing, the subsequent sheet is less affected by heat from the drying device 6 while the subsequent sheet is standing by.

Figure 41:
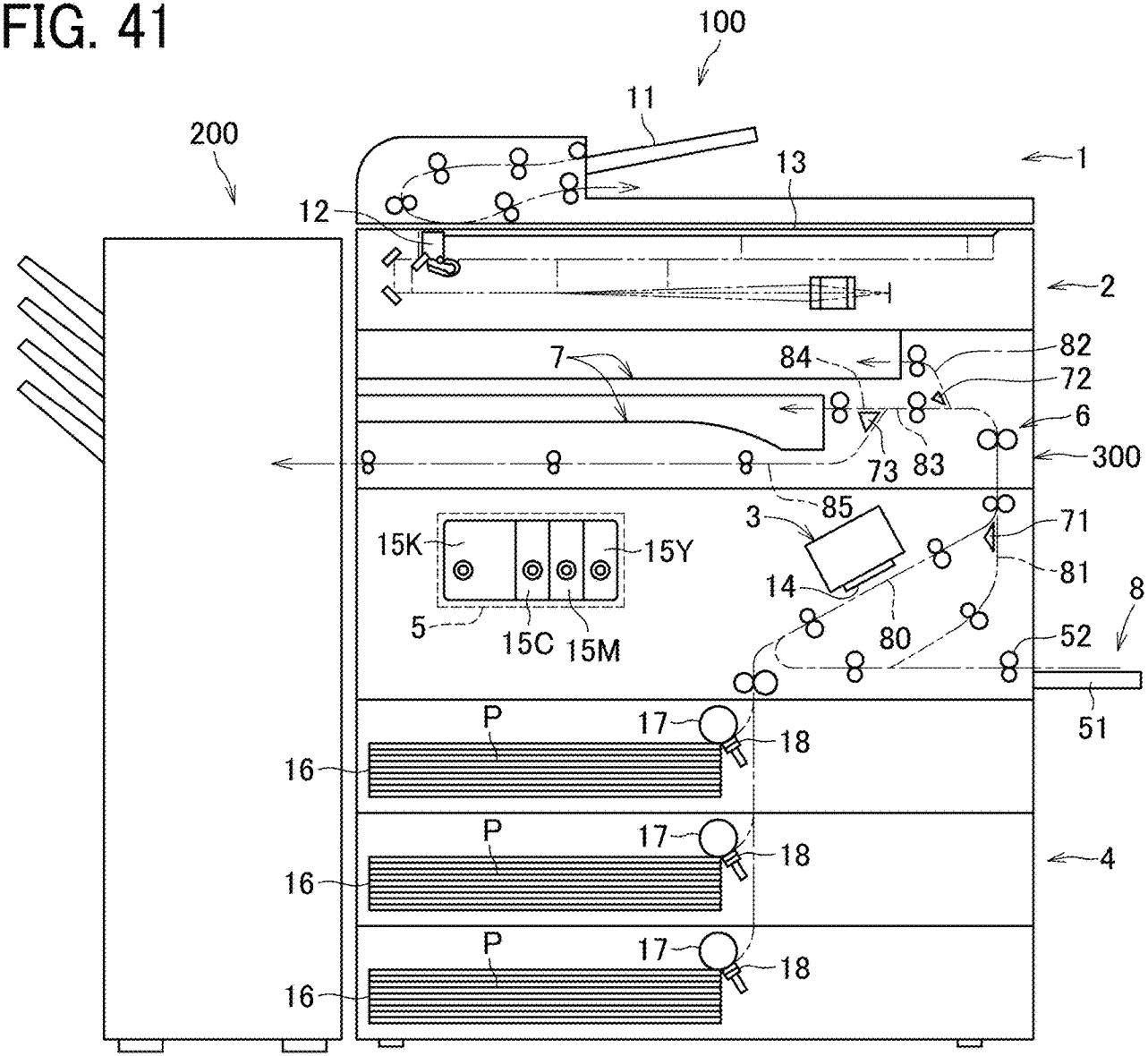
FIG. 41 is a diagram illustrating the configuration of yet another image forming apparatus.

FIG. 41 is a diagram illustrating an example that the conveying device according to the present disclosure is provided in a unit that is detachably attachable to the housing of the image forming apparatus 100.

As illustrated in FIG. 41, the present disclosure is applicable to the image forming apparatus 100 that includes a conveying device 300 detachably attachable to the housing of the image forming apparatus 100. In the example illustrated in FIG. 41, the conveying device 300 includes the drying device 6, the sheet ejection portion 7, and the sheet conveyance passages 82, 84, and 85. The sheet conveyance passages 82 and 84 convey the sheet P that has passed the drying device 6, to the sheet ejection portion 7. The sheet conveyance passage 85 conveys the sheet P that has passed the drying device 6, to the post-processing apparatus 200. In this case, the subsequent sheet is also stopped in an area other than the heat area of the drying device 6. By so doing, the subsequent sheet is less affected by heat from the drying device 6 while the subsequent sheet is standing by in the area.

Figure 42:
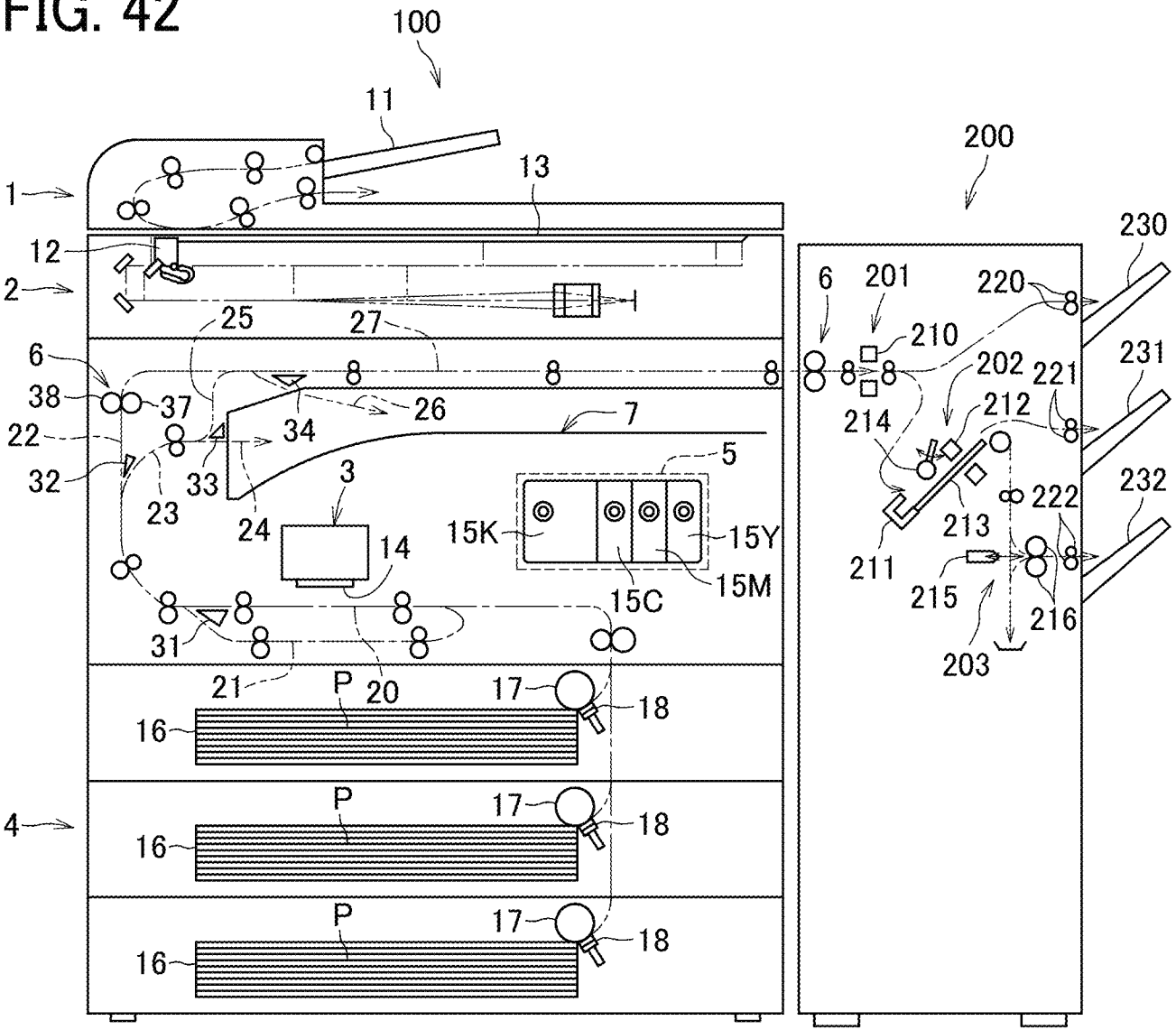
FIG. 42 is a diagram illustrating the configuration of a post-processing apparatus provided with a drying device.

Further, FIG. 42 is a diagram illustrating the configuration of a post-processing apparatus provided with a drying device.

As illustrated in FIG. 42, the present disclosure is applicable to the drying device 6 that is not provided in the image forming apparatus 100 but is provided in the post-processing apparatus 200. In the example illustrated in FIG. 42, since the drying device 6 is located at the entrance of the post-processing apparatus 200, in other words, since the drying device 6 is disposed upstream from the hole puncher 201 in the sheet conveyance direction, while the post-processing operation is performed on the preceding sheet, it is preferable that the subsequent sheet is stopped in the sheet conveyance passage in the image forming apparatus 100. By so doing, the subsequent sheet stands by in an area other than the heat area of the drying device 6.

As described above, in the liquid applying apparatus according to the present disclosure, the drying device may be provided in the image forming device or may be provided in the post-processing apparatus. Further, the post-processing apparatus may be separated from the image forming apparatus or may be integrated with the image forming apparatus as a single unit. For example, the post-processing apparatus 200 may be provided to the sheet ejection portion 7. That is, as long as the liquid applying apparatus according to the present disclosure includes a liquid applier to apply liquid to a sheet, a heating device to heat the sheet on which the liquid is applied by the liquid applier, and a post-processing apparatus to perform the post-processing operation to the sheet after the sheet has passed the heating device, these devices of the liquid applying apparatus may be separated from each other or may be integrated as a single unit.

Further, the liquid applier is not limited to a device employing the method of directly applying liquid from the liquid discharge head 14 to the sheet P as in the above-described embodiment.

Figure 43:
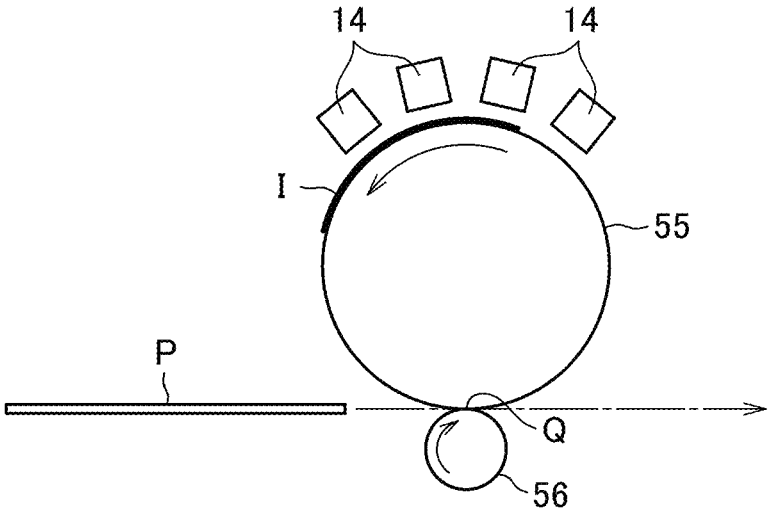
FIG. 43 is a diagram illustrating the configuration of a liquid applier that applies liquid to a sheet via a rotary body.

For example, FIG. 43 is a diagram illustrating the configuration of a liquid applier that applies liquid to a sheet via a rotary body.

As illustrated in FIG. 43, the liquid applier may be a device employing a method of indirectly applying liquid by discharging, e.g., the ink I from the liquid discharge head 14 to the surface of a drum-shaped rotary body 55 and contacting the rotary body 55 with the ink I on the surface of the rotary body 55, to the sheet P. In other words, the liquid discharge head 14 applies liquid onto the surface of the rotary body 55 and the rotary body 55 contacts the sheet P to apply the liquid on the surface of the rotary body 55 onto the sheet P. In this case, the contact portion Q (nip region) of an opposed rotary body 56 that is disposed facing the rotary body 55 is a liquid application position at which liquid is applied to the sheet P.

The liquid applied to the sheet by the liquid applier is liquid such as ink that forms an image on a sheet or may be processing liquid that is discharged on the surface of a sheet not for the purpose of forming an image on a sheet but for the purpose of modifying the surface of a sheet.

Further, the sheet used in the liquid applying apparatus according to the present disclosure may be paper sheet, resin, metal, cloth, or leather.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid applying apparatus comprising:

a liquid applier configured to discharge liquid to a sheet;

a heating device configured to heat the sheet on which the liquid is applied, by the liquid applier; and a post-processing apparatus configured to perform a post-processing operation to the sheet that has passed the heating device, wherein an upstream sheet conveyed after the sheet and located upstream from the post-processing apparatus in a sheet conveyance direction stops in an area other than a heating area of the heating device when the post-processing apparatus performs the post-processing operation on the sheet.

2. The liquid applying apparatus according to claim 1, wherein the upstream sheet stops between the post-processing apparatus and the heating device when a length of the upstream sheet in the sheet conveyance direction is shorter than a distance between the post-processing apparatus and the heating device.

3. The liquid applying apparatus according to claim 1, wherein the liquid applier is configured to stop an ink discharging operation when the upstream sheet is stopped at a liquid application position of the liquid applier.

4. The liquid applying apparatus according to claim 1, wherein the upstream sheet stops in an area other than a liquid application position of the liquid applier.

5. The liquid applying apparatus according to claim 1, further comprising circuitry configured to control a sheet conveying operation, wherein the post-processing apparatus is configured to perform the post-processing operation according to a plurality of operation types having different post-processing times to perform the post-processing operation, and wherein the circuitry is configured to control stop and conveyance of the upstream sheet according to the plurality of operation types.

6. The liquid applying apparatus according to claim 5, wherein the circuitry is configured to:

stop the upstream sheet at a predetermined stop position in a case in which an arrival time of the upstream sheet from when the sheet is conveyed to the post-processing apparatus to when the upstream sheet reaches the predetermined stop position is shorter than a post-processing time for the post-processing operation; and convey the upstream sheet without stopping the upstream sheet at the predetermined stop position in a case in which the arrival time of the upstream sheet from when the sheet is conveyed to the post-processing apparatus to when the upstream sheet reaches the predetermined stop position is equal to or longer than the post-processing time for the post-processing operation.

7. The liquid applying apparatus according to claim 6, wherein the circuitry is configured to stop heating the heating device when the upstream sheet is stopped at the predetermined stop position.

8. The liquid applying apparatus according to claim 1, wherein the heating device includes a heating member configured to contact the sheet to heat the sheet, and wherein the upstream sheet stops in an area in which the upstream sheet does not contact the heating member while the post-processing apparatus performs the post-processing operation on the sheet.

9. The liquid applying apparatus according to claim 1, further comprising a rotary body, wherein the liquid applier is configured to apply the liquid onto a surface of the rotary body and the rotary body is configured to contact the sheet to apply the liquid on the surface onto the sheet.

* * * * *